US010468737B2

(12) United States Patent
Dogiamis et al.

(10) Patent No.: US 10,468,737 B2
(45) Date of Patent: Nov. 5, 2019

(54) ASSEMBLY AND MANUFACTURING FRIENDLY WAVEGUIDE LAUNCHERS

(71) Applicants: Georgios C. Dogiamis, Chandler, AZ (US); Sasha N. Oster, Chandler, AZ (US); Adel A. Elsherbini, Chandler, AZ (US); Telesphor Kamgaing, Chandler, AZ (US)

(72) Inventors: Georgios C. Dogiamis, Chandler, AZ (US); Sasha N. Oster, Chandler, AZ (US); Adel A. Elsherbini, Chandler, AZ (US); Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 53 days.

(21) Appl. No.: 15/859,482

(22) Filed: Dec. 30, 2017

(65) Prior Publication Data

US 2019/0207287 A1 Jul. 4, 2019

(51) Int. Cl.

| | |
|---|---|
| ***H01P 5/10*** | (2006.01) |
| ***H01P 5/107*** | (2006.01) |
| ***H01P 3/02*** | (2006.01) |
| *H01Q 13/08* | (2006.01) |
| *H01Q 13/10* | (2006.01) |

(52) U.S. Cl.
CPC ..... *H01P 5/1007* (2013.01); *H01P 3/026* (2013.01); *H01P 5/1015* (2013.01)

(58) Field of Classification Search
CPC ..... H01Q 13/00; H01Q 13/10; H01Q 13/08; H01P 5/1007; H01P 5/1015
USPC ..... 333/26; 343/767, 770
See application file for complete search history.

(56) References Cited

U.S. PATENT DOCUMENTS

| | | | | |
|---|---|---|---|---|
| 4,853,704 A * | 8/1989 | Diaz | H01Q 13/085 | 343/767 |
| 5,519,408 A * | 5/1996 | Schnetzer | H01Q 13/085 | 343/767 |
| 5,825,333 A * | 10/1998 | Kudoh | H01Q 1/247 | 343/781 R |
| 6,317,094 B1 * | 11/2001 | Wu | H01Q 13/085 | 343/767 |
| 7,403,169 B2 * | 7/2008 | Svensson | H01Q 13/085 | 343/767 |

(Continued)

*Primary Examiner* — Dean O Takaoka
(74) *Attorney, Agent, or Firm* — Schwabe, Williamson & Wyatt, P.C.

(57) ABSTRACT

Embodiments include waveguide launchers and connectors (WLCs), and a method of forming a WLC. The WLC has a waveguide connector with a waveguide launcher, a taper, and a slot-line signal converter; and a balun structure on the slot-line signal converter, where the taper is on the slot-line signal converter and a terminal end of the waveguide connector to form a channel and a tapered slot. The WLC may have the waveguide connector disposed on the package, and a waveguide coupled to waveguide connector. The WLC may include assembly pads and external walls of the waveguide connector electrically coupled to package. The WLC may have the balun structure convert a signal to a slot-line signal, and the waveguide launcher converts the slot-line signal to a closed waveguide mode signal, and emits the closed signal along channel and propagates the closed signal along taper slot to the waveguide coupled to waveguide connector.

25 Claims, 13 Drawing Sheets

(56) References Cited

U.S. PATENT DOCUMENTS

| | | | | |
|---|---|---|---|---|
| 8,970,440 | B2 * | 3/2015 | Miyata | H01P 5/107 343/700 MS |
| 9,142,889 | B2 * | 9/2015 | Pazin | H01Q 13/106 |
| 9,979,066 | B2 * | 5/2018 | Natsuhara | H01P 5/107 |
| 10,256,521 | B2 * | 4/2019 | Elsherbini | H01P 5/1007 |
| 2013/0120206 | A1 * | 5/2013 | Biancotto | H01Q 21/005 343/776 |
| 2014/0218251 | A1 * | 8/2014 | Waschenko | H01Q 13/10 343/770 |
| 2018/0090848 | A1 * | 3/2018 | Elsherbini | H01P 5/10 |

* cited by examiner

ASSEMBLY AND MANUFACTURING FRIENDLY WAVEGUIDE LAUNCHERS

FIELD

Embodiments relate to semiconductor packaging. More particularly, the embodiments relate to semiconductor packages with a waveguide launcher and connector.

BACKGROUND

As more devices become interconnected and users consume more data, the demand placed on servers accessed by users has grown commensurately and shows no signs of letting up in the near future. Among others, these demands include increased data transfer rates, switching architectures that require longer interconnects, and extremely cost and power competitive solutions.

There are many interconnects within server and high performance computing (HPC) architectures today. These interconnects include within blade interconnects, within rack interconnects, and rack-to-rack or rack-to-switch interconnects. In today's architectures, short interconnects (for example, within rack interconnects and some rack-to-rack) interconnects are achieved with electrical cables—such as Ethernet cables, co-axial cables, or twin-axial cables, depending on the required data rate. For longer distances, optical solutions are employed due to the very long reach and high bandwidth enabled by fiber optic solutions. As new architectures emerge, such as 100 Gigabit Ethernet, traditional electrical connections, however, are becoming increasingly expensive and power hungry to support the required data rates. For example, to extend the reach of a cable or the given bandwidth on a cable, higher quality cables may need to be used or advanced equalization, modulation, and/or data correction techniques employed which add power and latency to the system. For some distances and data rates required in proposed architectures, there is no viable electrical solution today. Optical transmission over fiber is capable of supporting the required data rates and distances, but at a severe power and cost penalty, especially for short to medium distances, such as a few meters.

BRIEF DESCRIPTION OF THE DRAWINGS

Embodiments described herein illustrated by way of example and not limitation in the figures of the accompanying drawings, in which like references indicate similar features. Furthermore, some conventional details have been omitted so as not to obscure from the inventive concepts described herein.

DETAILED DESCRIPTION

Figure 1:
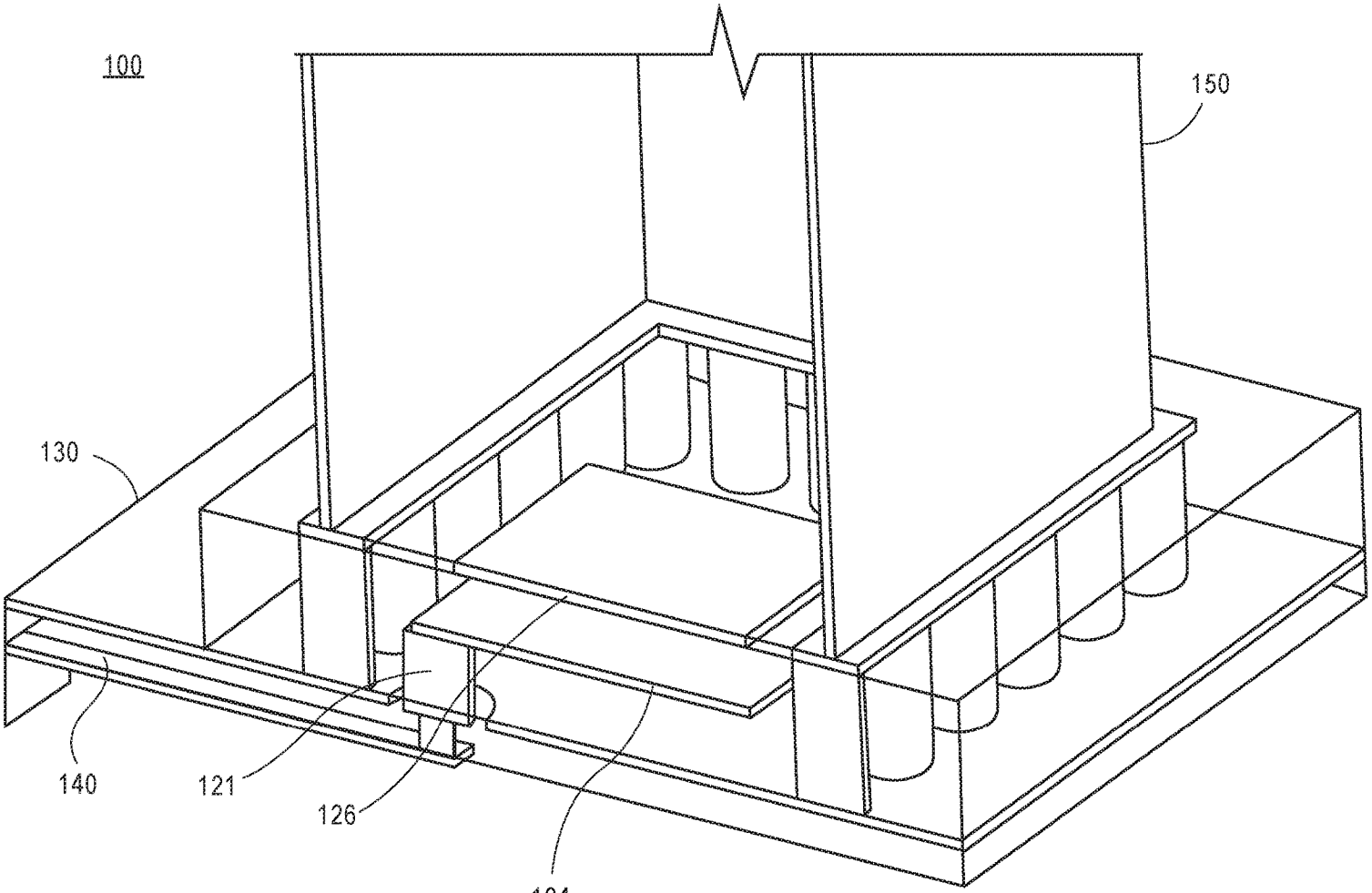
FIG. 1 is a perspective view of a waveguide launcher system that includes a waveguide connector, one or more stacked-patch launchers, and a package.

Described herein are systems that include a waveguide launcher and connector for exciting waveguides. Specifically, as described below, a waveguide launcher system includes a package having a microstrip feedline and one or more layers, and a waveguide connector having a slot-line converter, a balun structure (or a dumbbell shaped structure/opening), and a tapered slot launcher. Likewise, a method of forming such system is described below that includes disposing a waveguide connector on a package; aligning a microstrip feedline on the package with a slot-line converter disposed on the waveguide connector; converting a microstrip signal of the microstrip feedline to a slot-line signal with a balun structure disposed on the slot-line converter; and propagating a closed waveguide mode signal with a tapered slot launcher disposed on the waveguide connector, where the tapered slot launcher converts the slot-line signal produced by the slot-line converter to the closed waveguide mode signal (e.g., a TE10 signal for an operably coupled rectangular waveguide).

Accordingly, the waveguide launcher system described herein may be used to propagate the closed waveguide mode signal along a waveguide communicatively coupled to the tapered slot launcher and the waveguide connector. For some embodiments, the waveguide connector can be a fully-integrated and standalone surface-mount technology (SMT) component disposed on the package, or a partially-integrated SMT component in which, according to this implementation, the slot-line converter with the balun structure is patterned/printed on the package and then the partly integrated SMT component is disposed on the package. These embodiments described herein enable lower cost and higher performance millimeter-wave (mm-wave) waveguides to be fabricated using more standard and lower cost dielectrics, which additionally enables reducing the cost and power requirements for data communication between server racks at datacenters and server farms.

In the following description, various aspects of the illustrative implementations will be described using terms commonly employed by those skilled in the art to convey the substance of their work to others skilled in the art. However, it will be apparent to those skilled in the art that the present embodiments may be practiced with only some of the described aspects. For purposes of explanation, specific numbers, materials and configurations are set forth in order to provide a thorough understanding of the illustrative implementations. However, it will be apparent to one skilled in the art that the present embodiments may be practiced without the specific details. In other instances, well-known features are omitted or simplified in order not to obscure the illustrative implementations.

Various operations will be described as multiple discrete operations, in turn, in a manner that is most helpful in understanding the present embodiments, however, the order of description should not be construed to imply that these operations are necessarily order dependent. In particular, these operations need not be performed in the order of presentation.

As used herein the terms "top," "bottom," "upper," "lower," "lowermost," and "uppermost" when used in relationship to one or more elements are intended to convey a relative rather than absolute physical configuration. Thus, an element described as an "uppermost element" or a "top element" in a device may instead form the "lowermost element" or "bottom element" in the device when the device is inverted. Similarly, an element described as the "lowermost element" or "bottom element" in the device may instead form the "uppermost element" or "top element" in the device when the device is inverted.

As data transfer speeds continue to increase, cost efficient and power competitive solutions are needed for communication between blades installed in a rack and between nearby racks. Such distances typically range from less than 1 meter to about 10 meters. The systems and methods disclosed herein use millimeter-wave (mm-wave) transceivers paired with waveguides to communicate data between blades and/or racks at transfer rates in excess of 25 gigabits per second (Gbps). The mm-wave launchers used to transfer data may be disposed (or formed) and/or positioned in, on, or about the semiconductor package. A significant challenge exists in aligning the mm-wave launcher with the waveguide member to maximize the energy transfer from the mm-wave launcher to the waveguide member. Further difficulties may arise when one realizes the wide variety of available waveguide member. Although metallic and metal coated waveguide members are prevalent, such waveguide connectors may include rectangular, circular, polygonal, oval, and other shapes. These waveguide members may include hollow members, members having a conductive and/or non-conductive internal structure, and hollow members partially or completely filled with a dielectric material.

Ideally, a waveguide is coupled to a semiconductor package in a location that maximizes the energy transfer between the mm-wave launcher, the waveguide connector, and the waveguide. Such positioning, however, is often complicated by the shape and/or configuration of the waveguide system itself, the relatively small dimensions associated with the waveguide (e.g., 2 millimeters or less), the relatively tight tolerances required to maximize energy transfer (e.g., 100 micrometers or less), and precisely positioning the waveguide proximate a mm-wave launcher and connector that are potentially hidden beneath the surface of the semiconductor package.

The systems and methods described herein provide new, novel, innovative, and improved systems and methods for manufacturing, positioning/assembling, and coupling waveguides and waveguide connectors to semiconductor packages, such that energy transfer from the mm-wave launcher and the waveguide connector to the waveguide is improved, e.g., over current patch and stacked patch emitter designs. The systems and methods described herein provide new, novel, innovative, and improved systems and methods for manufacturing, positioning/assembling, and coupling waveguides and waveguide connectors to semiconductor packages, enabling (i) a wider bandwidth in thinner packages, (ii) a higher launcher efficiency with the traveling wave launcher as compared to more traditional structures that use resonant patch launchers, and (iii) an improved (and easier) assembly and manufacturing of the launcher and connectorization (mating) system.

The system and methods disclosed herein implement a new launcher and waveguide connector for exciting mm-Wave signals in waveguides, where the waveguide connector may be a fully-integrated and standalone surface-mount technology (SMT) component that is then disposed and coupled to a semiconductor package. As described herein, a waveguide launcher system may have a package having a microstrip feedline and one or more conductive layers, and a waveguide connector having a slot-line signal converter, one or more balun structures, and one or more tapered slot launchers. For some embodiments, the waveguide launcher system helps to provide a power-competitive solution that can support very high data rates, e.g., over short to medium distances, which would be extremely advantageous for interconnects within server and HPC architectures and/or autonomous/self-driving vehicles. Furthermore, the waveguide launcher system includes tapered-slot launchers and connectors for exciting the waveguides which enables thin package substrates to be used as the demand for miniaturization persistently increases.

For example, existing semiconductor package mounted launchers include a patch or stacked patch structure electrically coupled to the waveguide walls. Such "patch" or "stacked patch" installations suffer from limited bandwidth for thin semiconductor package substrates, and consequently employ the use of relatively thick semiconductor package substrates. Such thick semiconductor package substrates may cause manufacturing and assembly limitations. In addition, such waveguide/semiconductor package patch systems are sensitive to waveguide alignment and conductive coupling to the signal generator in the semiconductor package.

Figure 3:
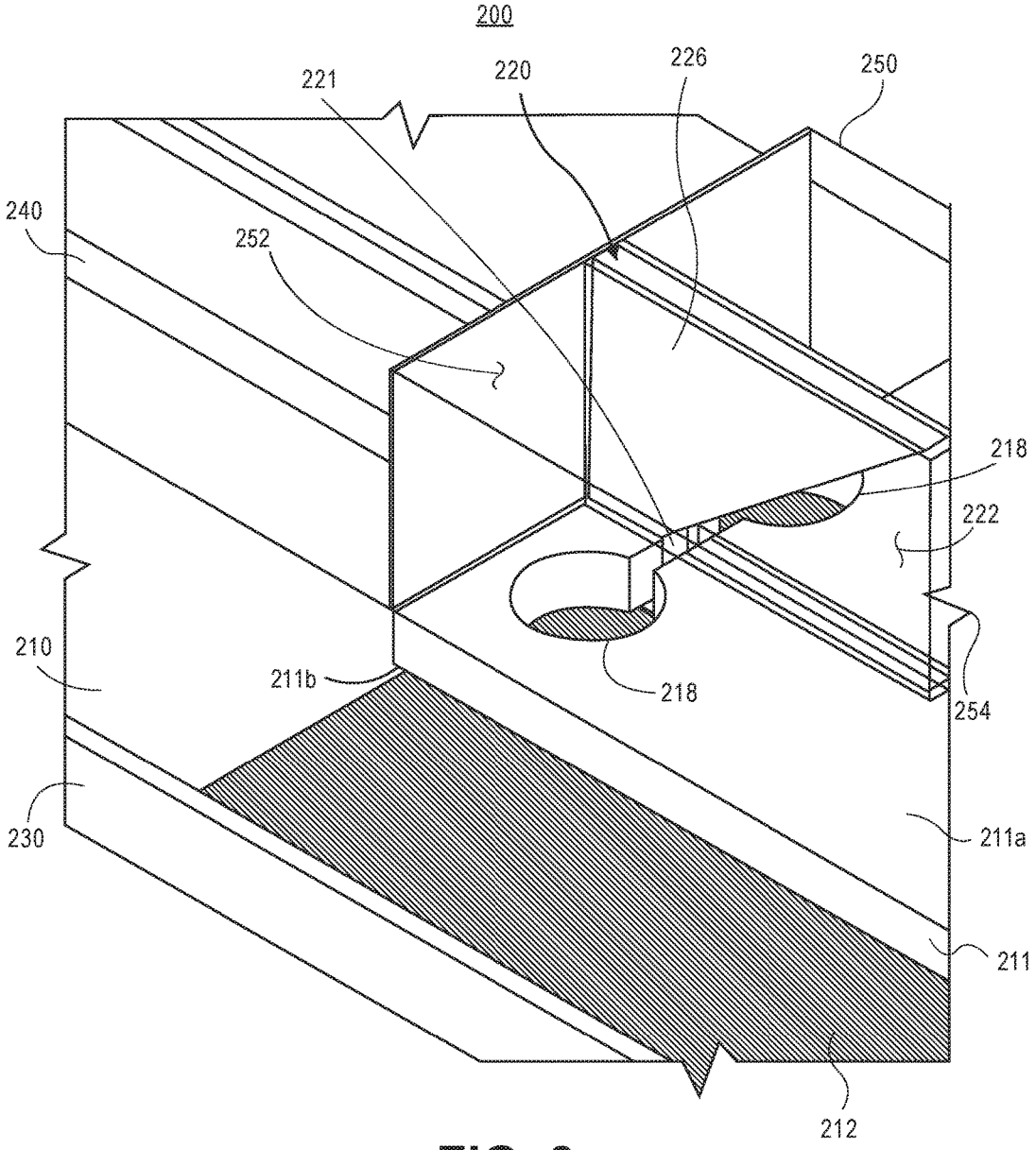
FIG. 3 is a detailed perspective view of a waveguide launcher system that includes a package having a first layer, a second layer, and a microstrip feedline, and a waveguide connector having a slot-line signal converter, a balun structure, and a tapered slot launcher, according to one embodiment.

The systems and methods described herein employ a different type of excitation structure, a tapered slot launcher and connector that is compatible with and may be disposed (assembled, placed, formed, etc.) on a package using conventional printed circuit board (PCB) manufacturing processes. Note that, as used herein, a "tapered slot launcher and connector" (also referred to as a tapered slot waveguide launcher/connector, a tapered slot launcher, and/or a tapered slot connector, etc.) may refer to a waveguide connector that has a tapered slot launcher structure disposed inside the one or more walls of the waveguide connector (e.g., as shown in FIG. 3). Also note that the "tapered slot launcher and connector" may be a single, fully-integrated SMT component or separate components that are assembled together on the semiconductor package.

The tapered slot launcher systems described herein include a tapered slot launcher that includes at least one of a single planar slot/member (e.g., as shown in FIGS. 2-6 and 9), and coplanar, spaced-apart, first and second planar members that together form the tapered slot launcher (e.g., as shown in FIGS. 7-8 and 10-11). This horizontal and/or vertical tapered slot launcher and connector may be incorporated into a waveguide such that when the waveguide is conductively coupled to a semiconductor package, the tapered slot launcher and connector have a balun structure in a slot-line signal converter that is aligned and disposed on the surface of the semiconductor package, where a microstrip signal from a microstrip feedline on the package may be transmitted to the balun structure on the slot-line signal converter of the launcher/connector.

Figure 9:
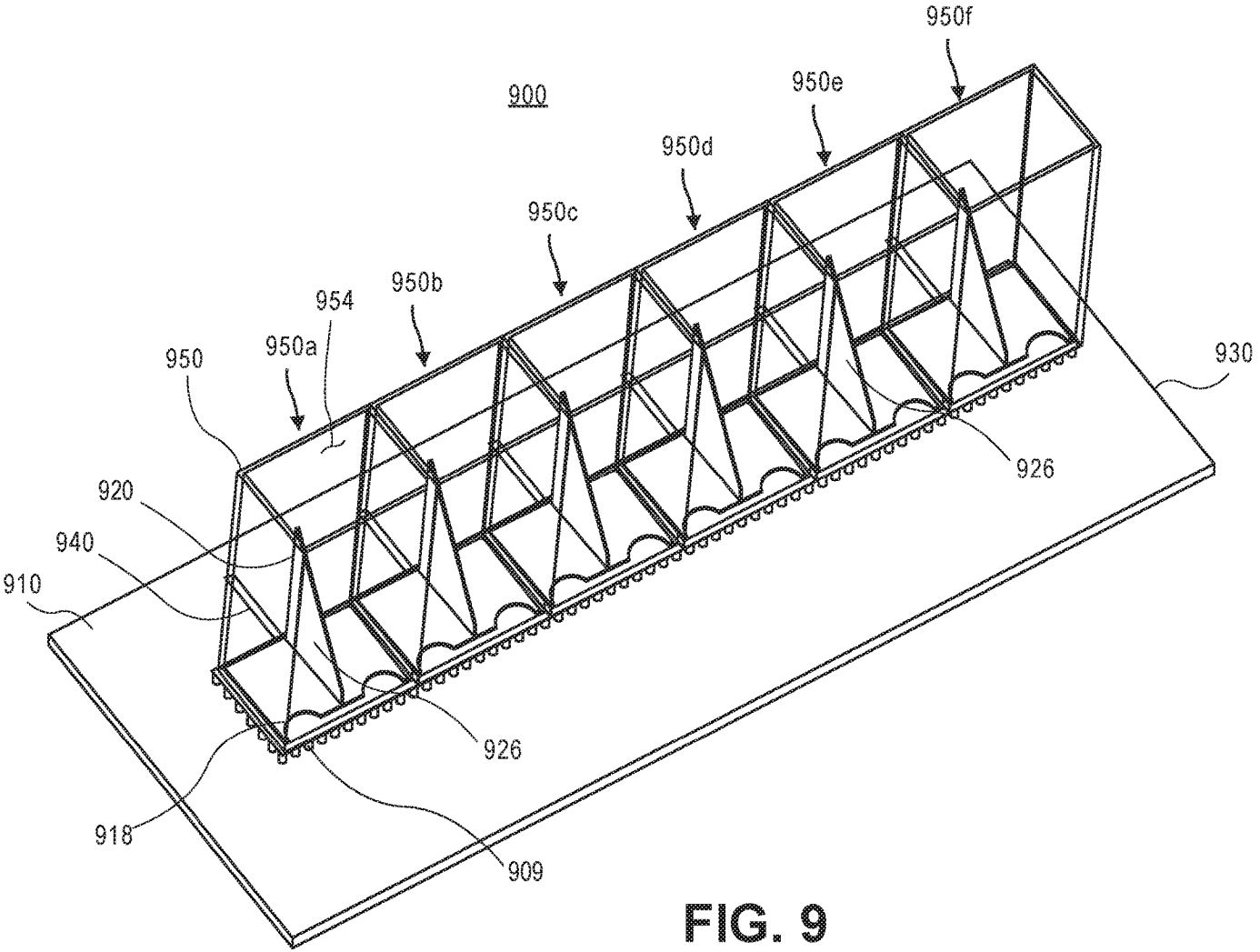
FIG. 9 is a perspective view of a vertical waveguide launcher system that includes a waveguide connector having one or more arrayed compartments with one or more tapers, according to one embodiment.

The tapered slot launcher converts a slot-line signal provided by the slot-line signal converter to a closed waveguide type signal that may propagated to other nodes via a waveguide. Tapered slot launchers beneficially provide wider bandwidth and greater energy efficiency over patch and stacked patch launchers. Such tapered slot launchers, as described below, may be beneficially combined to provide space saving two-dimensional and three-dimensional waveguide arrays—a significant advantage in the confines of a typical datacenter rack environment. Such tapered slot launchers described herein are also less sensitive to manufacturing tolerances. For example, compared to patch or stacked patch launchers, the systems and methods described herein beneficially provide increased bandwidth in a thinner semiconductor package. In addition, beneficially, the systems and methods described herein may be adapted to dielectric waveguides through the use of 180 degree opposed slot launchers and may also be adapted to various waveguide geometries by adjusting the shape of the outline on the semiconductor package to match the geometry of the waveguide (e.g., as shown in FIGS. 9-11).

FIG. 1 is a perspective view of a waveguide launcher system 100 that includes a waveguide connector 150, one or more patch launchers 124 and 126, and a package 130. The waveguide launcher system 100 uses standard package/PCB launchers that typically include stacked patches 124 and 126 (or a patch) electrically coupled to the walls of the waveguide connector 150. The waveguide launcher system 100 may have a feeding transmission line 140 (e.g., feed from a semiconductor die) that is electrically coupled to a via feed structure 121, which is also electrically coupled to the patch launcher 124 to transmit a waveguide signal.

As noted above, the waveguide launcher system 100 typically suffers from a limited bandwidth when using a thin package substrate, as such the package 130 requires using relatively thick substrates that lead to various manufacturing and assembly limitations (e.g., the patch launchers as shown in FIG. 1 are typically sensitive to the waveguide alignment and electrical contacts). Therefore, a new launcher and connector architecture for exciting the waveguides is needed, including an architecture that is also manufacturing and assembly friendly, and offers a power-competitive solution that can support very high data rates over short to medium distances.

FIGS. 2A-2D illustrate a waveguide launcher system 200 having a package 230 and a waveguide connector 250 that uses a tapered slot launcher 220 for exciting a waveguide, according to some embodiments. Additionally, FIGS. 2A-2D illustrate a fully-integrated and standalone SMT waveguide connector 250 disposed on the package 230 and mated to a rectangular waveguide 254. The waveguide launcher system 200 includes the fully-integrated SMT waveguide connector 250 with a waveguide launcher 220, a taper 226, and a slot-line signal converter 221. The waveguide launcher system 200 also includes a balun structure 218 on the slot-line signal converter 221, where the taper 226 is disposed on the slot-line signal converter 22 and a terminal end 252 of the waveguide connector 250 to form a channel 211 and a tapered slot 222.

Figure 2A:
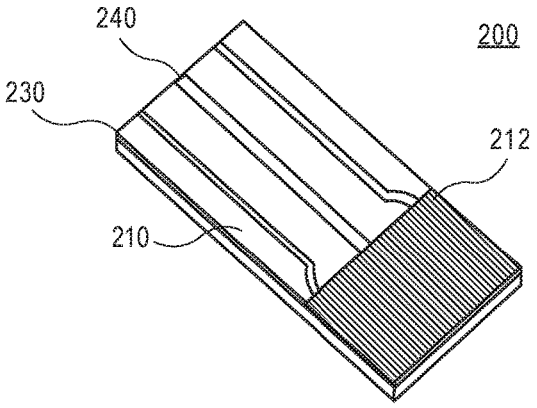
FIG. 2A is a perspective view of a waveguide launcher system that includes a package having a first layer, a second layer, and a microstrip feedline, according to one embodiment.
Figure 2B:
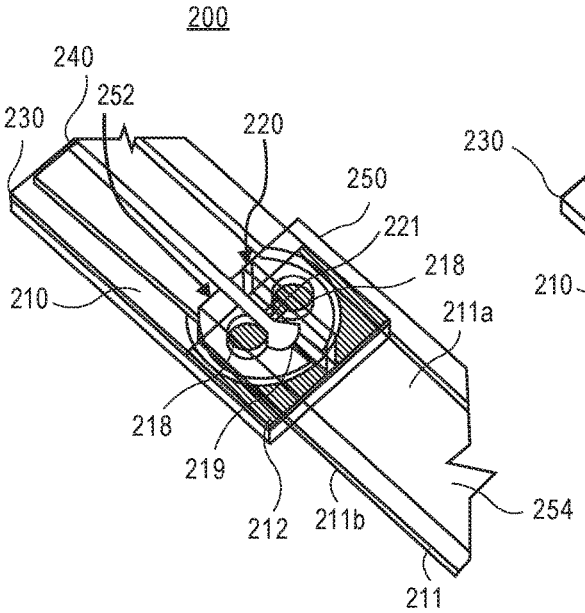
FIG. 2B is a perspective view of a waveguide launcher system that includes a package having a first layer, a second layer, and a microstrip feedline, and a waveguide connector having a slot-line signal converter, a balun structure, and a tapered slot launcher, according to one embodiment.
Figure 2C:
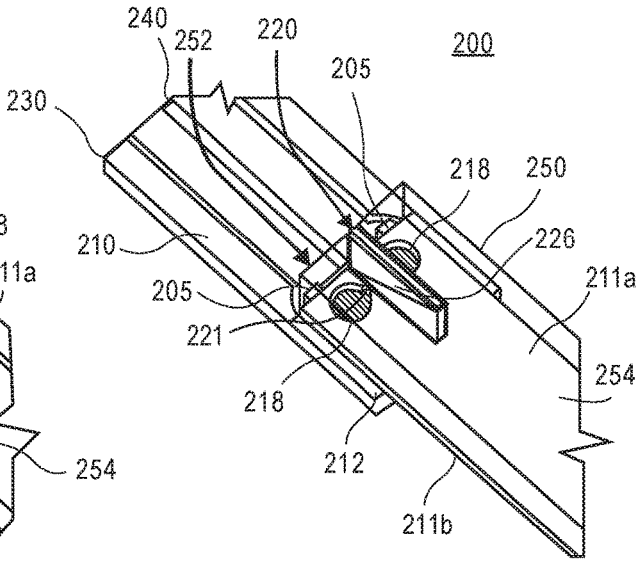
FIG. 2C is a perspective view of a waveguide launcher system that includes a package having a first layer, a second layer, and a microstrip feedline, and a waveguide connector having a slot-line signal converter, a balun structure, and a tapered slot launcher, according to one embodiment.
Figure 2D:
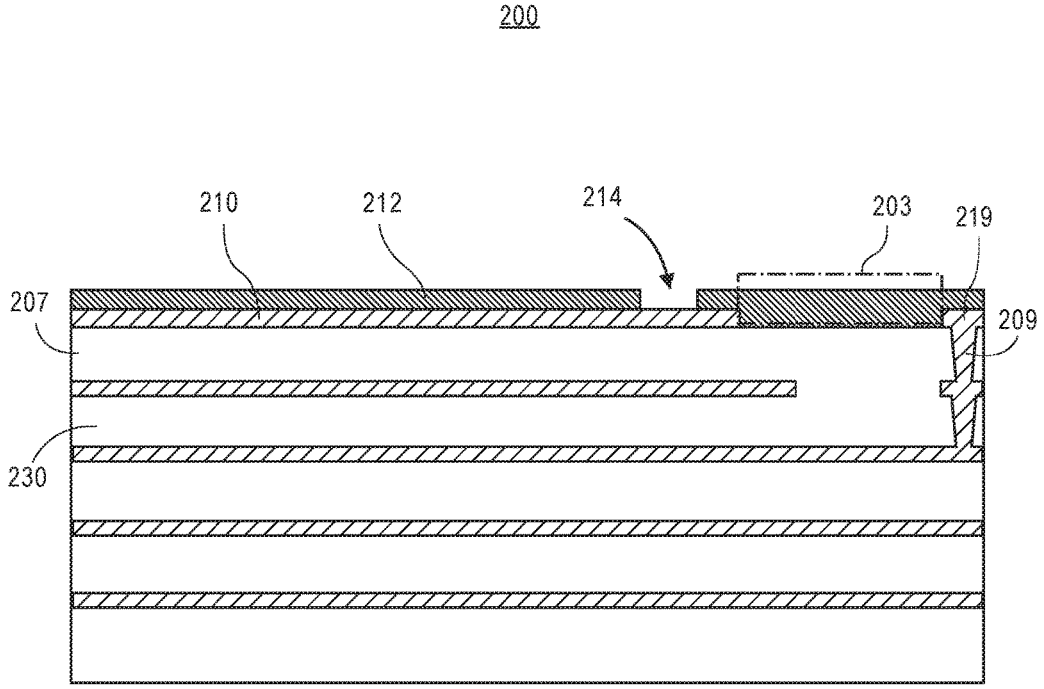
FIG. 2D is a cross-sectional view of a waveguide launcher system that includes a package with a first layer, a second layer, and one or more dielectric layers, according to one embodiment.

Note that each of the FIGS. 2A-2D highlights a component of the waveguide launcher system 200 (e.g., FIG. 2A shows the package, FIG. 2B shows the alignment of a microstrip feedline of the package and a slot-line signal converter of the waveguide connector, FIG. 2C shows a tapered slot launcher 120 of the waveguide connector disposed on a top surface of the package, and FIG. 2D shows one or more layers of the package). Also note that the waveguide connectors, as shown in the Figures herein, are illustrated as transparent to simplify the Figures and/or avoid confusion (i.e., allow the Figures to be more readable).

Referring now to FIG. 2A, a perspective view of a waveguide launcher system 200 is illustrated. FIG. 2A shows a package 230 having a microstrip feedline 240, a first layer 212, and a second layer 210, according to one embodiment. For one embodiment, the first layer 212 may be disposed on a portion of the second layer 210, where the first layer 212 may have any size and/or shape that is needed (e.g., based on the size and shape of the waveguide connector that may be disposed on the first layer 212). In one embodiment, the first layer 212 may be a solder mask and/or a dielectric layer (or the like). For one embodiment, the second layer 210 is a top conductive layer (or a top metal layer), where the top conductive layer is a ground (GND) plane layer (also referred to as package GND). Note that, for one embodiment, the first layer 212 may be optional as such the top surface of the package 230 is the second layer 210 (which may include one or more openings formed on the second layer 210). Also note that the GND vias coupling the one or more conductive layers of the packages (e.g., package 230), as shown illustrated herein, have been omitted for clarity.

According to one embodiment, the package 230 may include, but is not limited to, a semiconductor package, a package/substrate, a PCB, a motherboard, a high-density interconnect (HDI) board, a ceramic substrate, or any organic semiconductor packaging substrate. For one embodiment, the package 230 is a PCB. For one embodiment, the PCB is made of an FR-4 glass epoxy base with thin copper foil laminated on both sides (not shown). For certain embodiments, a multilayer PCB can be used (e.g., as illustrated in FIG. 2D), with pre-preg and copper foil (not shown) used to make additional layers. For example, the multilayer PCB may include one or more dielectric layers, where each dielectric layer can be a photosensitive dielectric layer (as shown in FIG. 2D). For some embodiments, holes (not shown) may be drilled in the package 230. For one embodiment, the package 230 may also include conductive copper traces, holes, metallic pads, and vias (as shown in FIG. 2D).

Figure 5B:
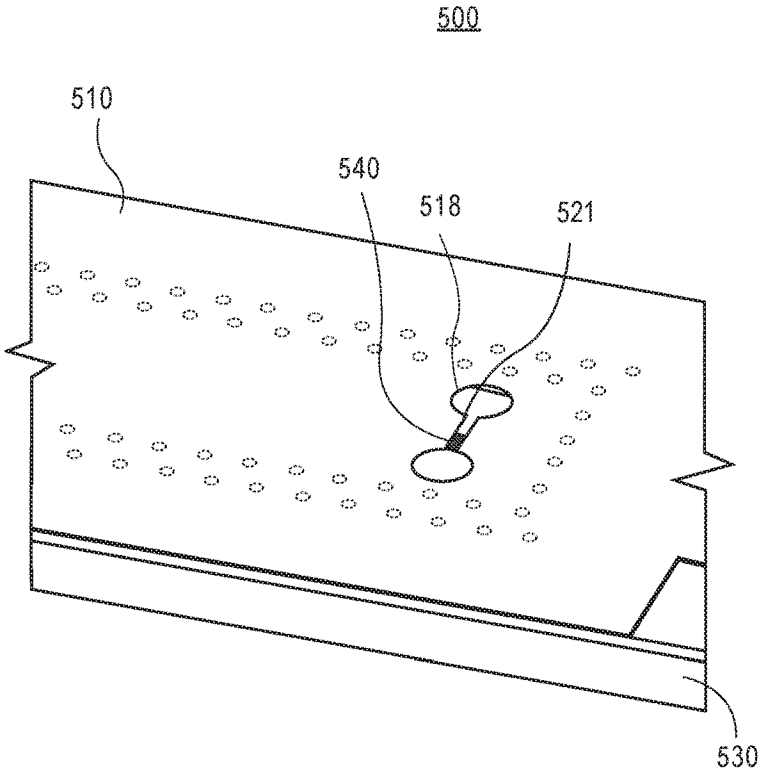
FIG. 5B is a perspective view of a waveguide launcher system that includes a package with a top conductive layer, a balun structure, and a microstrip feedline, according to one embodiment.

The package 230 may transmit a signal received from a source (e.g., a die, a sensor, etc.) via the microstrip feedline 240 to a balun structure 218 (e.g., a dumbbell-shaped opening) disposed on a bottom surface of a waveguide connector 250 (as shown in FIGS. 2B-2C). As such, in these embodiments illustrated in FIGS. 2A-2D, the waveguide connector 250 may be referred to a fully-integrated SMT component that can be assembled using standard PCB assembly techniques on the package 230. Alternatively, for other embodiments, a package may transmit a signal received from a source via a microstrip feedline to a balun structure formed (or printed) on a top surface of the package (e.g., as shown in FIGS. 5B-5C).

Note that the waveguide launcher system 200 as shown in FIG. 2A may include fewer or additional packaging components based on the desired packaging design.

FIG. 2B is a perspective view of the waveguide launcher system 200 including the package 230 with the first layer 212, the second layer 210, and the microstrip feedline 240, and a waveguide connector 250 with a slot-line signal converter 221, a balun structure 218, and a tapered slot launcher 220, according to one embodiment. Specifically, FIG. 2B shows a connection point 219 (as further shown in FIG. 2D) that aligns the microstrip feedline 240 of the package 230 and the balun structure 218 on the slot-line signal converter 221 of the waveguide connector 250. Note that one or more well-known features may be omitted or simplified in order not to obscure the illustrative implementations.

As shown in FIG. 2B, the waveguide connector 250 is an enclosure formed of one or more walls with an open end 154 to accommodate the operable coupling of an external waveguide to the waveguide connector 150. For one embodiment, the waveguide connector 250 is a fully-integrated SMT component as such the bottom surface of the waveguide connector 250 has a slot-line signal converter 221. In some embodiments, the waveguide connector 250 may have any size, shape, physical geometry and/or physical configuration for operably coupling an external waveguide to the tapered slot launcher 220. For some embodiments, the waveguide connector 250 may have one or more connection features disposed about all or a portion of the open end 254 of the waveguide connector 250. Such connection features may include, but are not limited to, mechanical latches, friction or resistance fit pillars, alignment pins, keyed structures or similar structures, flared ends, high friction coatings or surface treatments, or combinations thereof. In some implementations, the external waveguide may operably couple to the waveguide connector 250 via solder, a conductive adhesive, or similar conductive bonding agent.

For one embodiment, the waveguide connector 250 is disposed on the top surface of the package 230 to align a connection point 219 that aligns the microstrip feedline 240 of the package 230 and the balun structure 218 on the slot-line signal converter 221. The connection point 219 (or a feed point) may be a broadband radial stub termination that does not use any conductive via. Alternatively, the connection point 219 may include, but is not limited to, any radial stub, a via, and any other shaped stubs, such as a circular stub, a semi-circular stub, a semi-rectangular stub, etc.

In one embodiment, the waveguide connector 250 may be coupled to the package 230 using an opening (e.g., the opening 214 as shown in FIG. 2D) on the first layer 212 that couples the external walls of the waveguide connector 250 to the exposed second layer 210 via the opening. For one embodiment, the external walls of the waveguide connector 250 may be coupled to the package 230 using solder paste printing, epoxy dispensing, or the like.

Upon operable coupling of the waveguide connector 250 to the second layer 210 of the package 230, the tapered slot launcher 220 extends at least partially into the waveguide connector 250. The tapered slot launcher 220 may generate a closed waveguide mode signal (as described below) from the signal transmitted by the microstrip feedline 240 and may then propagate the closed waveguide mode signal along the waveguide connector 250 to the external waveguide 254. For some embodiments, the waveguide launcher system 200 has a waveguide launcher that is a tapered slot launcher 220. For other embodiments, the waveguide launcher system 200 has a waveguide launcher that may include, but is not limited to, a patch based launcher, a tapered slot based launcher, a stacked-patch launcher, a microstrip-to-slot transition launcher, a leaky-wave launcher, or any other mm-wave signal launching structure.

Although depicted as a rectangular waveguide connector in FIGS. 2B and 2C, the waveguide connector 250 may have any transverse geometric cross-section. In some embodiments, the first layer 212 of the package 230 may be physically configured to match one or more physical aspects (e.g., the perimeter geometry) of the waveguide connector 250. Thus, for example, where the waveguide connector 250 has a round or oval cross-section, the first layer 212 on the package 230 may have a physical configuration corresponding to the perimeter of the waveguide connector 250. In some embodiments, the waveguide connector 250 may include a hollow, electrically conductive waveguide connector (e.g., a metallic waveguide connector). In other embodiments, the waveguide connector 250 may include a solid or hollow dielectric waveguide connector. In some embodiments, the waveguide connector 250 may be at least partially filled with one or more dielectric materials which may also include metallic materials.

For one embodiment, the slot-line signal converter 221 includes a first electrically conductive member 211*b* (or a bottom surface of the slot-line signal converter) and a second electrically conductive member 211*a* (or a top surface of the slot-line signal converter) that are communicably coupled together. The first electrically conductive member 211*b* may be disposed in, on, or about at least a portion of the first and/or second layers 212 and 210 of the package 230. The first electrically conductive member 211*b* is physically coupled or otherwise affixed to the top surface of the package 230. The first electrically conductive member 211*b* may be communicatively coupled to one or more systems, structures, or devices disposed in, on, or about the package 130.

The slot-line signal converter 221 includes a balun structure 218 to convert a signal received from a source to a slot-line signal. In some embodiments, the balun structure 218 may include a dumbbell-shaped, double-lobed balun structure (or the like), and/or any other shapes, such as circular, rectangular, wedge-shaped, hexagonal, etc. For one embodiment, the shape of the balun structure 218 may be selected based on optimizing the performance given the available waveguide area. The first electrically conductive member 211*b* includes a balun structure having a first physical configuration and the second electrically conductive member 211*a* includes a balun structure having a second physical configuration. (Note, e.g., that FIGS. 2B-2C may show 211*a* and 211*b* to be formed out of a single metal piece with the same physical configurations that have been machined to include the balun structure 218 and the slot-line signal converter 221; however members 211*a* and 211*b* in some instances may not be the same or have different physical configurations (e.g., if a waveguide launcher had a taper in the balun openings, then members 211*a* and 211*b* may be different).

In some instances, the balun structure in the first electrically conductive member 211*b* may be the same as the balun structure in the second electrically conductive member 211*a*. In some instances, the balun structure in the first electrically conductive member 211*b* may be different than the balun structure in the second electrically conductive member 211*a*.

Figure 7:
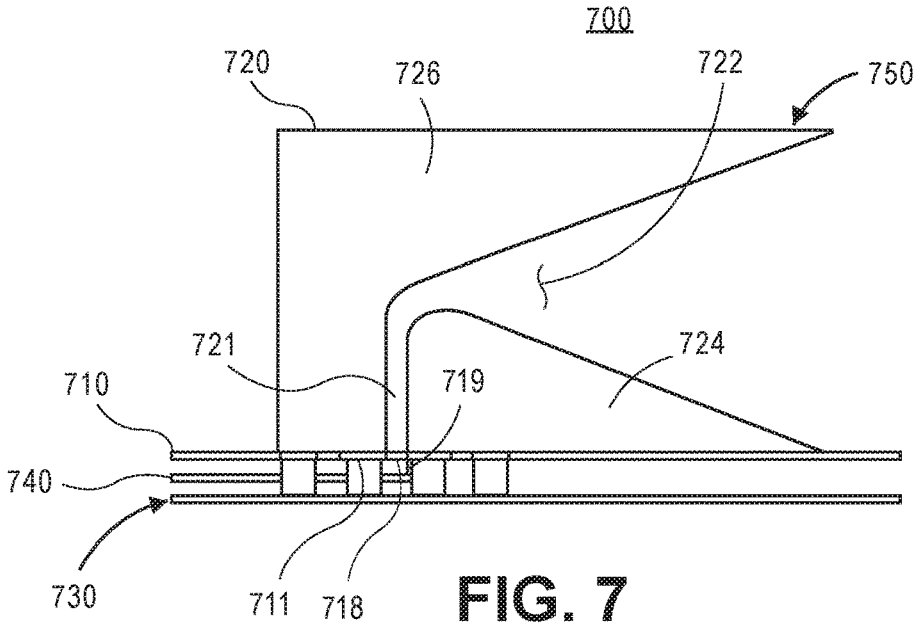
FIG. 7 is a cross-sectional view of a waveguide launcher system that includes a package having a top conductive layer, a connection point, and a microstrip feedline, and a waveguide connector having a slot-line signal converter, a balun structure, and a double tapered slot launcher, according to one embodiment.

The second electrically conductive member 211*a* is communicatively coupled to the tapered slot launcher 220. As shown in FIG. 2C, the tapered slot launcher 220 includes a taper 226 that physically and/or communicatively couples to the second electrically conductive member 211*a* at a first location and extends diagonally to a second location on the top inner wall of the waveguide connector 250. In some embodiments, the taper 226 is disposed in a spaced arrangement to form a feed channel (e.g., a feed channel 221 as shown in FIG. 3) with the connection point 219 and the balun structure 218. In embodiments, the taper 226 may be physically and/or conductively coupled to the second electrically conductive member 211*a* at a first location with respect to the balun structure 218 and at a second location on the top inner wall of the waveguide connector 250 with respect to the balun structure 218. In such embodiments, the first location and the second location may be disposed in opposition across (e.g., on opposite sides of) the balun structure 218 (i.e., the taper 226 is positioned based on the balun structure 218). Note that the tapered slot launcher 220 may include one or more co-planar tapered slots (e.g., as shown in FIG. 7), and the taper 226 may have any size and/or shape based on the desired package design and/or application.

The microstrip feedline 240 provides the signal to the balun structure 218. For one embodiment, the connection point 219 communicably couples the microstrip feedline 240 to the balun structure 218. The two lobes of the balun structure 218 produce an impedance matched slot-line signal. The tapered slot launcher 220 converts the slot-line signal produced by the balun structure 218 to a closed waveguide mode signal (e.g., a TE10 signal for an operably coupled rectangular waveguide) that propagates along a waveguide 254 operably coupled to the tapered slot launcher 220 via the waveguide connector 250. The traveling-wave signal propagates along a slot channel (e.g., a slot-line channel 221 of FIG. 3) and is emitted by the tapered slot launcher 220. The traveling wave signal propagates along the waveguide operably coupled to the tapered slot launcher 220 via the waveguide connector 250 (note, as noted above, the waveguide connector 250 has been illustrated as transparent for simplification and clarity). As described herein, the waveguide may be at least one of a metallic waveguide, a dielectric waveguide, and a dielectric waveguide having a metallic coating (note that, unlike in datacenter applications, an embodiment may include using a non-metallic coated dielectric waveguide where density and crosstalk are not an issue).

For some embodiments, the slot-line signal converter 210 converts the microstrip signal from the microstrip feedline 240 to a slot-line signal. The microstrip signal may, in some implementations, be generated or otherwise created and supplied/transmitted to the microstrip feedline 240 and then to the slot-line signal converter 221 by one or more components, such as a mm-wave die disposed on or communicably coupled to the semiconductor package 230. In some embodiments, the microstrip signal may include, but is not limited to, a signal at a microwave frequency (e.g., from roughly 30 GHz to about 300 GHz). Note that other signal frequencies may be used to equal effect. Additionally, for other embodiments, a microstrip line may include any other line type that may be used as a feed structure, such as a grounded coplanar waveguide (GCPW) line or a coplanar waveguide (CPW) line, or a stripline.

For one embodiment, the slot-line signal converter 221 may be of any shape, size, or configuration. As described above, in some embodiments, the slot-line signal converter 221 may be formed (and integrated) with the tapered slot launcher 220 and the waveguide connector 250. For alternative embodiments, the slot-line signal converter 221 may be formed on a top surface of a package (e.g., as shown in FIG. 5B) or as a separate component which may then be stacked with a package and a waveguide connector. In some embodiments, the first electrically conductive member 211*b* may be formed, patterned, or otherwise disposed on the top surface of the package 230. In other embodiments, the first electrically conductive member 211*b* may be disposed on the top surface of the package 230 and conductively and/or physically coupled to one or more electrical contacts (e.g., vias, pads, lands, or similar electrically conductive structures) disposed on the top surface of the package 230. In such embodiments, the first electrically conductive member 211*b* may be physically and conductively coupled to one or more electrical contacts via solder, an electrically conductive adhesive, or similar electrically conductive bonding or affixation systems and methods. For other embodiments, the first electrically conductive member 211*b* and the top surface of the package 230 do not require any conductive connection (i.e., there is no need of any conductive connection under the body of the SMT connector, but there may still be a conductive connection around the edges of the SMT connector). Note that, as described below in FIG. 2C, the waveguide launcher system 200 may include one or more assembly pads (e.g., assembly pads 205 of FIG. 2C) disposed on one or more external walls of the waveguide connector 250 that may be used to electrically couple the package 230 and the waveguide connector 250.

The slot-line signal converter 221 converts the received microstrip signal to a slot-line mode signal (i.e., two impedance matched signals) using the balun structure 218. The balun structure 218 may include a double-lobed or dumbbell-type balun structure 218 as shown in FIGS. 2B and 2C. The balun structure 218 may receive the input microstrip signal at a central location on the structure, such as a connection point 219. The open spaces in the balun structure 218 provide an impedance matched slot line signal that is communicated to the communicably coupled slot-line signal converter 221. For some embodiments, where the slot-line signal converter 221 is a single member having the first electrically conductive member 211*b* and the second electrically conductive member 211*a*, the balun structure 218 may be symmetric across the thickness of the slot-line signal converter 221 (i.e., the physical configuration of the balun structure 218 on the top surface and the bottom surface of the slot-line signal converter 221 may be identical). In some embodiments, the balun structure 218 may be asymmetric across the thickness of the slot-line signal converter 221 (i.e., the physical configuration of the balun structure 218 on the top surface and the bottom surface of the slot-line signal converter 221 may be different).

The balun structure 218 may include a double lobed structure having symmetric or asymmetric lobes with any physical configuration. As such, the lobes forming the balun structure 218 may be, but are not limited to, semi-circular, circular, semi-oval, oval, semi-polygonal, polygonal, rectangular, wedged-shape, hexagonal, etc., to optimize the performance given the available waveguide area. The physical dimensions and/or configuration of the lobes forming the balun structure 218 may be based in whole or in part on the operating frequency and/or frequency range of the microstrip signal supplied by the microstrip feedline 240 to the slot-line signal converter 221.

For one embodiment, the tapered slot launcher 220 with the taper 226 transitions the axis of propagation of the slot-line mode signal provided by the balun structure 218 (and the feed channel) to a different axis of propagation (e.g., to the axis facing the open end of the waveguide 254) and converts the signal to the closed waveguide mode signal that propagates along the waveguide 254. In some embodiments, the axis of propagation of the closed waveguide mode signal may be parallel to the external surface of the semiconductor package 130. In some embodiments, the axis of propagation of the closed waveguide mode signal may be aligned with or parallel to a longitudinal axis of the waveguide connector 250 coupled to the traveling wave launcher system 200.

Note that the waveguide launcher system 200 as shown in FIG. 2B may include fewer or additional packaging components based on the desired packaging design.

FIG. 2C is a perspective view of the waveguide launcher system 200 including the package 230 with the first layer 212, the second layer 210, and the microstrip feedline 240, and a waveguide connector 250 with a slot-line signal converter 221, a balun structure 218, and a tapered slot launcher 220, according to one embodiment. Specifically, FIG. 2C shows the internal structure of the tapered slot launcher 220 and the waveguide connector 250 coupled to the external waveguide 254.

As noted above, the tapered slot launcher 220 on the waveguide connector 250 implements a different excitation structure, e.g., by using a tapered slot feed channel. The tapered slot feed channel (e.g., the feed channel 221 of FIG. 3) is fed with a microstrip feedline 240 terminated with a radial stub, such as the connection point 219, without the use of any conductive vias. For one embodiment, the microstrip feedline 240 is formed on a package layer (e.g., the second layer 210 of the package 230) using a process that is compatible with standard PCB manufacturing. As such, the assembled structure of the tapered slot launcher 220, the waveguide connector 250, and the package 230 facilitates inherently wider bandwidth and is significantly less sensitive to the manufacturing tolerances. Note that, as shown below in further detail, the tapered slot launcher and connector can be either a standalone SMT component disposed on top of the package or can be partly patterned on the package and partly assembled on top of the package.

For some embodiments, the balun structure 218 disposed on the slot-line signal converter 221 are used to provide impedance matching (i.e., the balun structure 218 are used as inductive loads for the slot-line mode signal). Using the tapered slot launcher 220, the slot-line mode signal is transmitted through a feed channel (e.g., feed channel 221 of FIG. 3), translated in a vertical direction (i.e., perpendicular to the package 230), and propagated through the taper 226, where the slot-line mode signal is thus converted to the closed waveguide mode signal (e.g., TE10 for the rectangular waveguide). For some embodiments, the taper 226 may be formed with straight lines (e.g., as shown in FIGS. 2C, 3, 4C, and 5A). For other embodiments, the taper 226 may be formed with several shapes/types of tapers (e.g., stepped tapers, exponential, quadratic, elliptical, etc.) to optimize the performance and/or manufacturability of the waveguide connector 250.

Additionally, as noted above, taking into consideration the manufacturing and assembly boundary conditions, the slot-line signal converter 221 and the balun structure 218 can be formed either as a component on the top layer of a package (e.g., as shown in FIG. 5B) or a component of a fully-integrated and standalone SMT component (e.g., forming the bottom surface of the SMT component), which is directly disposed/assembled on top of the package 230 as shown in FIG. 2C. Note that, in both variations for example, the body of the component has to be electrically coupled to the second layer 210 of the package 230 (i.e., the package GND) using a conductive epoxy and the assembly pads 205 (e.g., as shown in FIG. 4C).

For other embodiments, there is no need of any conductive connection under the body of the SMT component (e.g., under the lowermost surface of the tapered slot launcher 220 and the waveguide connector 250), which can ease the assembly as the component is similar to any other standard SMT component. The assembly pads 205 (or legs/pins) formed around the external wall(s) of the waveguide connector 250 may be used to facilitate an easier assembly on the package 230 using standard SMT assembly procedures (or the like). Additionally, the assembly pads 205 can be used for self-alignment during a reflow assembly. Note that a single waveguide connector (e.g., the waveguide connector 250) can also be arrayed for exciting more than one waveguide (as shown in FIGS. 4-6).

Moreover, the one or more components of the waveguide launcher system 200 can additionally be formed with plastic injection molding (PIM) and/or overmolded. Using a PIM process (or overmolding) can be beneficial as the mating structures of the system 200 such as alignment pins, keyed features and the like can be facilitated on the mold to enable the proper mating between the waveguide and connector (e.g., a male-female mating approach).

Note that the waveguide launcher system 200 as shown in FIG. 2C may include fewer or additional packaging components based on the desired packaging design.

FIG. 2D is a cross-sectional view of a portion of the package 230 of the waveguide launcher system 200. For one embodiment, the package 230 includes the first layer 212, the second layer 210, and one or more dielectric layers 207, according to one embodiment.

As shown in FIG. 2D, the first layer 212 may be disposed on the second layer 210 and patterned to form an opening 214. The opening 214 of the first layer 212 is formed to couple the second layer 210 (the package GND) and the external walls of the waveguide connector (not shown) using a solder paste printing process, a conductive epoxy dispensing process, or any similar process. For one embodiment, the first layer 212 may be a solder mask, a resist layer, or any other dielectric layer. Note that the first layer 212 may be optional, as such the top surface of the package 230 is the second layer 210 according to this optional implementation.

For one embodiment, the package 230 has one or more dielectric layers 207 surrounding (disposing and/or adjacent to) the one or more conductive layers, where the second layer 210 is the top conductive layer that forms the GND plane of the package 230. According to this embodiment, when using a fully-integrated SMT waveguide connector (e.g., the waveguide connector 250 of FIGS. 2B-2C that includes the balun structure 218 on the bottom surface of the connector 250), the package 230 may have a connector land 203 used as a surface area/location where the SMT waveguide connector may be disposed.

For example, the connector land 203 may be formed between a ground via wall 209 and the second layer 210, where the ground via wall 209 may be formed around the perimeter/outline of the waveguide connector and electrically coupled to at least one or more conductive layers of the package 230. For another embodiment, the package 230 may have a different architecture (e.g., as shown in FIG. 5C) when the SMT connector does not include a balun structure on the bottom surface (and hence the SMT connector is partially integrated as the balun structure is formed/printed on the second layer 210 of the package). For one embodiment, the one or more assembly pads 205 of the waveguide connector 250 may be disposed on at least one or more openings 214 on the package 230 and then a reflow process (i.e., using solder) may be used to electrically couple (and/or affix) the external surface wall(s) of the connector 250 to the package ground on the package 530. For another embodiment, the one or more assembly pads 205 of the waveguide connector 250 may be disposed on at least one or more openings 214 on the package 230 and then an electrically conductive adhesive/epoxy may be used to electrically couple (and/or affix) the external surface wall(s) of the connector 250 to the package ground on the package 530.

Note that the waveguide launcher system 200 as shown in FIG. 2D may include fewer or additional packaging components based on the desired packaging design.

FIG. 3 is a more detailed perspective view of the waveguide launcher system 200 including the package 230 with the first layer 212, the second layer 210, and the microstrip feedline 240, and the waveguide connector 250 with the slot-line signal converter 221, the balun structure 218, and the tapered slot launcher 220, according to one embodiment. In FIG. 3, the waveguide launcher system 200 is illustrated with a close-up view of the tapered slot launcher 220 and the waveguide connector 250. Note that the waveguide launcher system 200 of FIG. 3 may be the same as the waveguide launcher system 200 of FIGS. 2A-2D. Also note that one or more well-known features may be omitted or simplified in order not to obscure the illustrative implementations.

For one embodiment, the waveguide launcher system 200 has a fully-integrated SMT component that can be assembled and disposed on the package 230 using standard PCB assembly techniques. The fully-integrated SMT component may include the tapered slot launcher 220 disposed in, on, or about at least a portion of the interior enclosure (or surfaces) of the waveguide connector 250 (i.e., the tapered slot launcher is formed integral with the waveguide connector 250), and the slot-line signal converter 221 with the balun structure 218 also disposed in, on, or about the bottom surface of the waveguide connector 250.

As shown in FIG. 3, having each of these components assembled/manufactured together as a single, fully-integrated, and standalone SMT component allows for an improved (and eased) assembly and manufacturing process for a waveguide launcher/connector system 200. In some embodiments, the taper 226 of the tapered slot launcher 220 and the slot-line signal converter 221 are disposed in a spaced arrangement to form a feed channel 221. The feed channel 221 aligns with a central portion of the balun structure 218 of the slot-line signal converter 221 and receives a microstrip signal from the microstrip feedline 240. The slot-line signal converter 221 then converts the microstrip signal to a slot-line mode signal using the balun structure 218 and transmits the slot-line mode signal via the feed channel 221. Using the taper 226, the tapered slot launcher 220 transitions the axis of propagation of the slot-line mode signal provided by the feed channel 221 to a different axis of propagation toward the open end 254 of the waveguide connector 250. The tapered slot launcher 220 has a tapered slot 222 that is formed with the taper 226 and the second electrically conductive member 211*a* of the slot-line signal converter 221.

The tapered slot launcher 220 converts the slot-line mode signal fed by the channel 221 to a closed waveguide mode signal that propagates along a waveguide (not shown). In some embodiments, the taper 226 of the tapered slot launcher 220 may be electrically isolated using, e.g., a thin insulator, a dielectric layer, or a similar material. For some embodiments, the waveguide launcher system 200 may be formed using one or more different manufacturing/assembly processes, such as, but not limited to, computer numerical control (CNC) or micro-CNC with optional consequent plating, metal-injection-molding, metal three-dimensional (3D) printing, plastic injection molding with metal coating and/or plastic 3D printing (temperature resistant) with metal coating. Note that, additionally, these manufacturing/assembly processes may then be followed with an overmolding process to enable proper mating between the waveguide and connector. Also note that the waveguide launcher system 200 maybe formed to have any size and/or shape based on the desired packaging design and application (e.g., the dimensions may be based on the operation frequency (e.g., if operating at roughly 60 GHz, the dimensions may be about 2.5 mm×2.5 mm, 3.5 mm×1.75 mm, and/or 4 mm×2 mm, etc., and/or if operating at roughly 120 GHz, the dimensions may be about 1.7 mm×0.85 mm and/or 2 mm×1 mm, etc.), the one or more component lengths (e.g., may vary from a few mms to centimeters (cms), and/or the wall thicknesses (e.g., may vary roughly between less than 50 um to several mms).

Note that the waveguide launcher system 300 may include fewer or additional packaging components based on the desired packaging design.

Figure 4A:
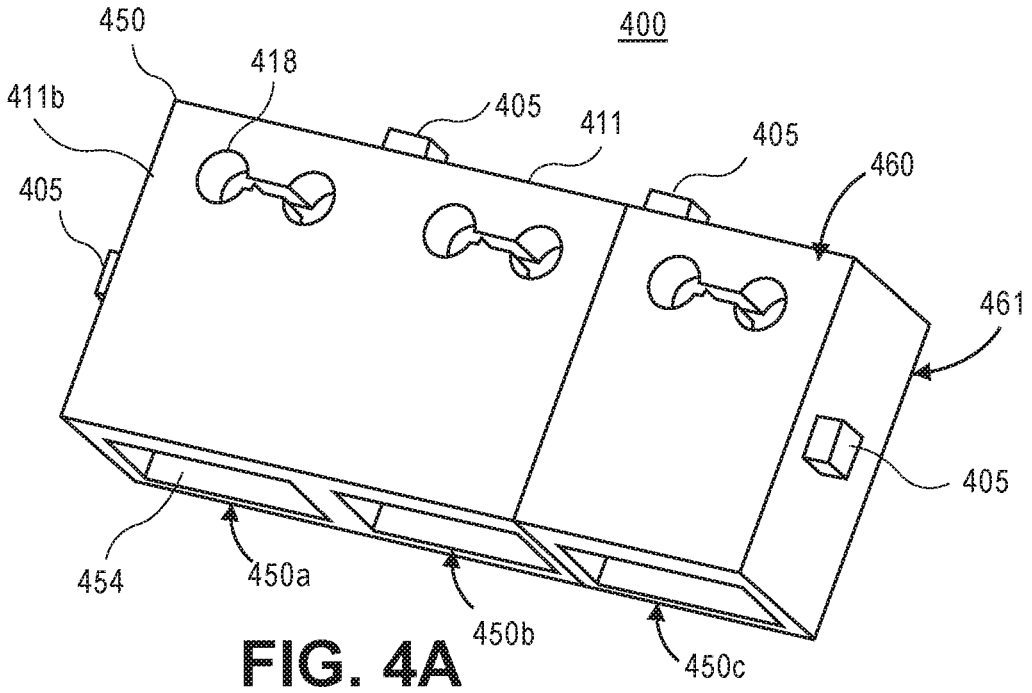
FIG. 4A is a perspective view of a waveguide launcher system that includes a waveguide connector having one or more compartments, according to one embodiment.
Figure 4B:
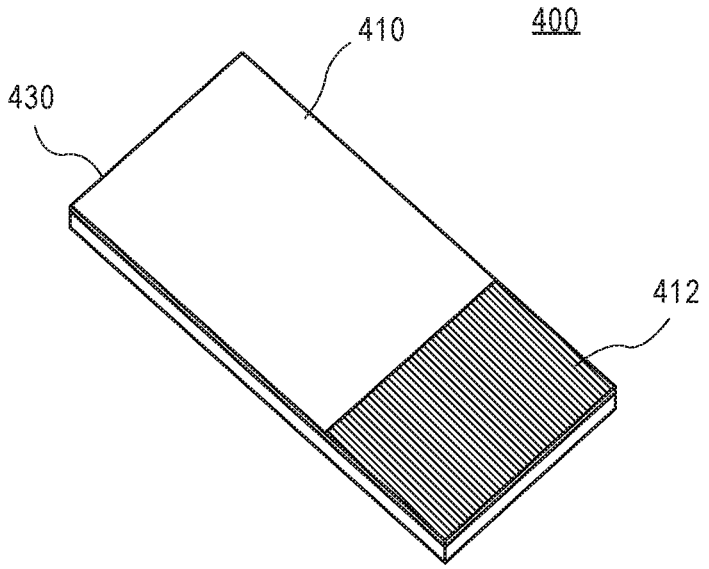
FIG. 4B is a perspective view of a waveguide launcher system that includes a package with a first layer and a second layer, according to one embodiment.
Figure 4C:
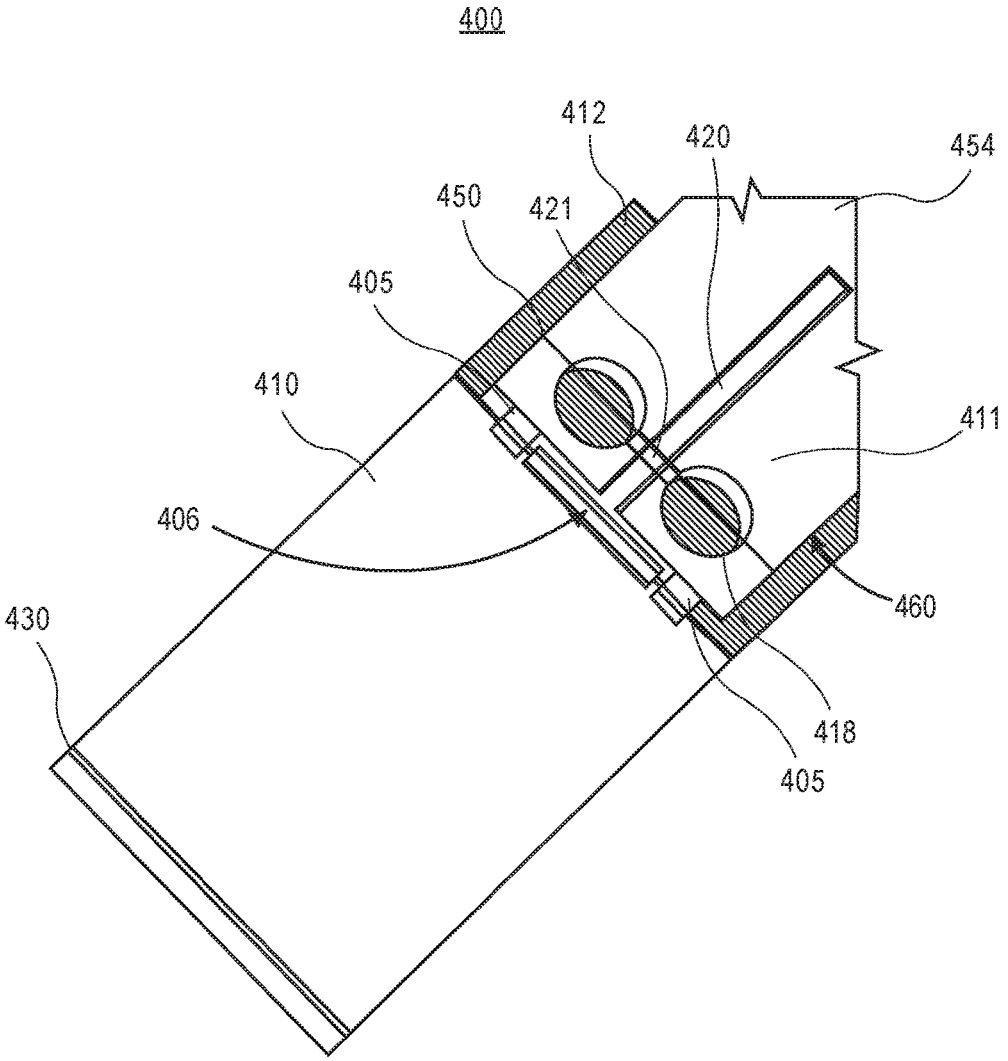
FIG. 4C is a plan and perspective view of a waveguide launcher system that includes a package having a first layer and a second layer, and a waveguide connector having a slot-line signal converter, a balun structure, a tapered slot launcher, and one or more assembly pads, according to one embodiment.

FIGS. 4A-4C illustrate a waveguide launcher system 400 having a package 430 and a waveguide connector 450 that uses a tapered slot launcher 420 for exciting a waveguide, according to some embodiments. Additionally, FIGS. 4A-4C illustrate a fully-integrated and standalone SMT waveguide connector 450 disposed on the package 430. The waveguide launcher system 400 may be similar to the waveguide launcher system 200 of FIGS. 2A-2D, but the waveguide launcher system 400 has a fully-integrated and patterned SMT waveguide connector 450 that is arrayed for exciting more than one waveguides (not shown). Note that each of the FIGS. 4A-4C highlights a component of the waveguide launcher system 400 (e.g., FIG. 4A shows the waveguide connector 450, FIG. 4B shows the package 430, and FIG. 4C shows one compartment of the waveguide connector 450 disposed on a top surface of the package 430 using a conductive layer 406 and one or more assembly pads 405.)

Referring now to FIG. 4A, a bottom, perspective view of the waveguide connector 450 of the waveguide launcher system 400 is illustrated. The waveguide connector 450 has one or more compartments (or enclosures) 450*a-c* that may be used to excite one or more waveguides. The waveguide connector 450 may be similar to the waveguide connector 250 of FIGS. 2A-2D but, as shown in FIG. 4A, the waveguide connector 450 has three compartments 450*a-c*, where each of the waveguide compartments 450*a-c* has an individual/separate waveguide launcher. Note that the waveguide connector 450 may have any number of compartments based on the desired packaging design.

The waveguide connector 450 has a bottom surface 460 and a top surface 461. The waveguide connector 450 includes one or more balun structures 418 disposed on the bottom surface 460. As noted above, each of the compartments 450*a-c* may be used as a separate waveguide connector, where each of the compartments 450*a-c* may have a tapered slot launcher and a slot-signal converter with one of the balun structures 418 (e.g., as shown in FIG. 4C). Each of the compartments 450*a-c* may be used to propagate a closed waveguide mode signal via a waveguide that may be communicatively coupled to an open end 454 formed in each of the compartments 450*a-c*.

For some embodiments, the waveguide connector 450 may have one or more assembly pads 405 disposed on one or more exterior walls of the waveguide connector 450. The one or more assembly pads 405 may be used to align and electrically couple the waveguide connector 450 and the package 430. The one or more assembly pads 405 may be disposed on the package 430 and then a reflow process (or the like) may be used to electrically couple (and/or affix) the external surface wall(s) of the connector 450 to a package ground on the package 430 (as shown in FIG. 4C).

Note that the waveguide launcher system 400 as shown in FIG. 4A may include fewer or additional packaging components based on the desired packaging design.

FIG. 4B is a top, perspective view of the package 430 of the waveguide launcher system 400. The package 430 has a first layer 412 and a second layer 210, according to one embodiment. For one embodiment, the first layer 412 may be disposed on a portion of the second layer 410, where the waveguide connector 450 may be disposed on the first layer 412 (as shown below in FIG. 4C). In one embodiment, the first layer 412 may be a solder mask and/or a dielectric layer. For one embodiment, the second layer 410 is a top conductive layer, where the top conductive layer is a GND plane layer. Note that, for one embodiment, the first layer 412 may be optional as such the top surface of the package 430 is the second layer 410.

Note that the waveguide launcher system 400 as shown in FIG. 4B may include fewer or additional packaging components based on the desired packaging design.

FIG. 4C is a top, perspective view of the waveguide launcher system 400 including the package 430 with the first layer 412 and the second layer 410, and the waveguide connector 450 with a slot-line signal converter 411, a balun structure 418, and a tapered slot launcher 420, according to one embodiment. Specifically, FIG. 4C shows the internal structure of the tapered slot launcher 420 and the waveguide connector 450. Note that one or more well-known features may be omitted or simplified in order not to obscure the illustrative implementations (e.g., the waveguide connector 450 has one or more compartments 450*a-c*, but only one compartment of the waveguide connector 450 is illustrated for simplicity).

For one embodiment, the waveguide connector 450 is disposed on a portion of the first layer 412. The body of the waveguide connector 450 may need to be coupled to the package GND (e.g., the second layer 410) using the conductive layer 406 (or a conductive epoxy layer) and the assembly pads 405. For example, the conductive layer 406 may be disposed on one or more external walls of the waveguide connector 450 or below the bottom surface 460 of the waveguide connector 450. The conductive layer 406 and the assembly pads 405 may be disposed on one or more openings (not shown) of the package that are exposed to the package GND, as such the conductive layer 406 and assembly pads 405 may be reflowed to electrically couple the connector 450 to the package GND of the package 430. The conductive layer 406 and assembly pads 405 formed around the SMT waveguide connector 450 may facilitate an easier assembly on the package 430 (e.g., using standard SMT assembly procedures) and be used for self-alignment during the reflow assembly/process.

The package 430 may have a microstrip feedline that transmits a signal to the balun structure 418 disposed on the slot-line signal converter 411. The tapered slot launcher 420 may have a feed channel 421 to receive the microstrip signal that is terminated with a broadband radial stub (also includes a via or any other type of stub). The balun structure 418 disposed on the slot-line signal converter 411 may be used to provide impedance matching and convert the microstrip signal to a slot-line mode signal. Using the tapered slot launcher 420, the slot-line mode signal is transmitted through a feed channel 421 and propagated through the tapered slot launcher 420, where the slot-line mode signal is converted to a closed waveguide mode signal to transmit along an open end of the connector 450 coupled to an external waveguide 454.

Note that the waveguide launcher system 400 as shown in FIG. 4C may include fewer or additional packaging components based on the desired packaging design.

Figure 5A:
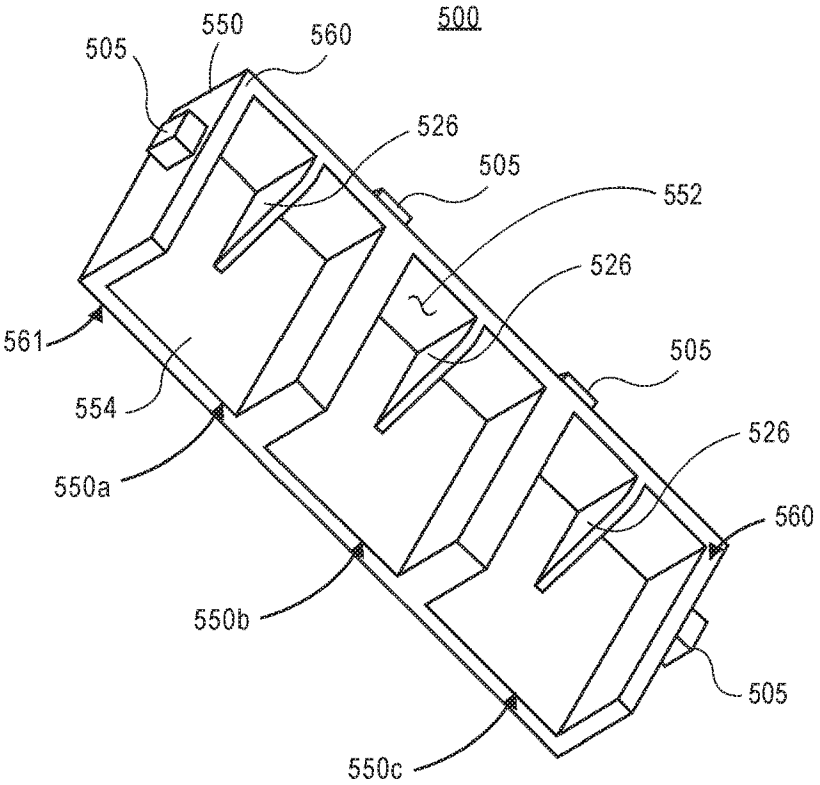
FIG. 5A is a perspective view of a waveguide launcher system that includes a waveguide connector having one or more compartments with one or more tapers, according to one embodiment.
Figure 5C:
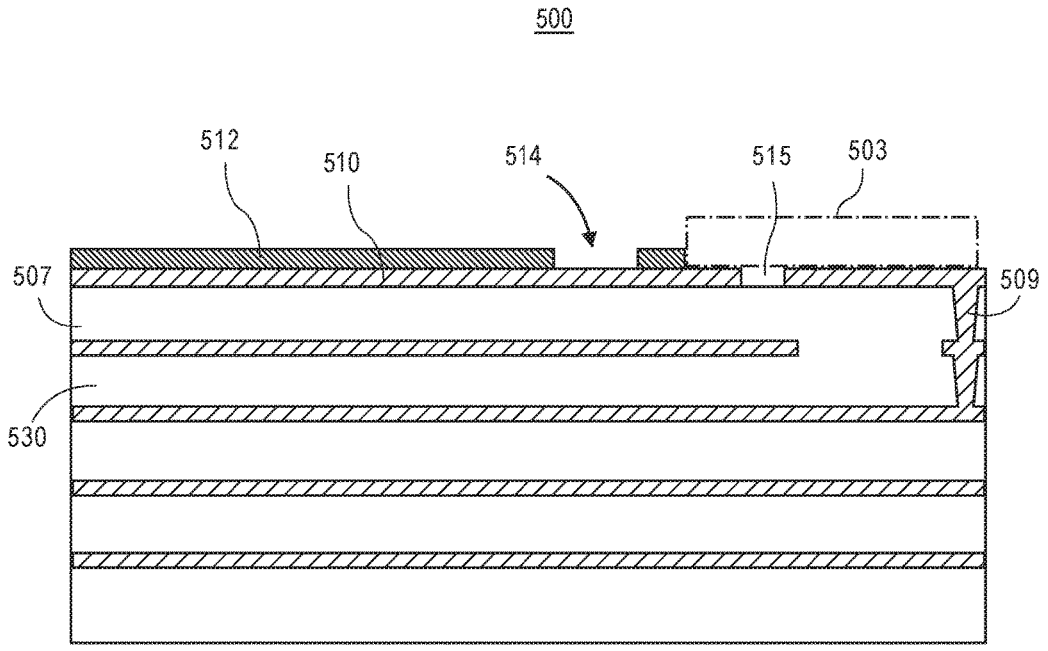
FIG. 5C is a cross-sectional view of a waveguide launcher system that includes a package with a first layer, a second layer, and one or more dielectric layers, according to one embodiment.
Figure 6:
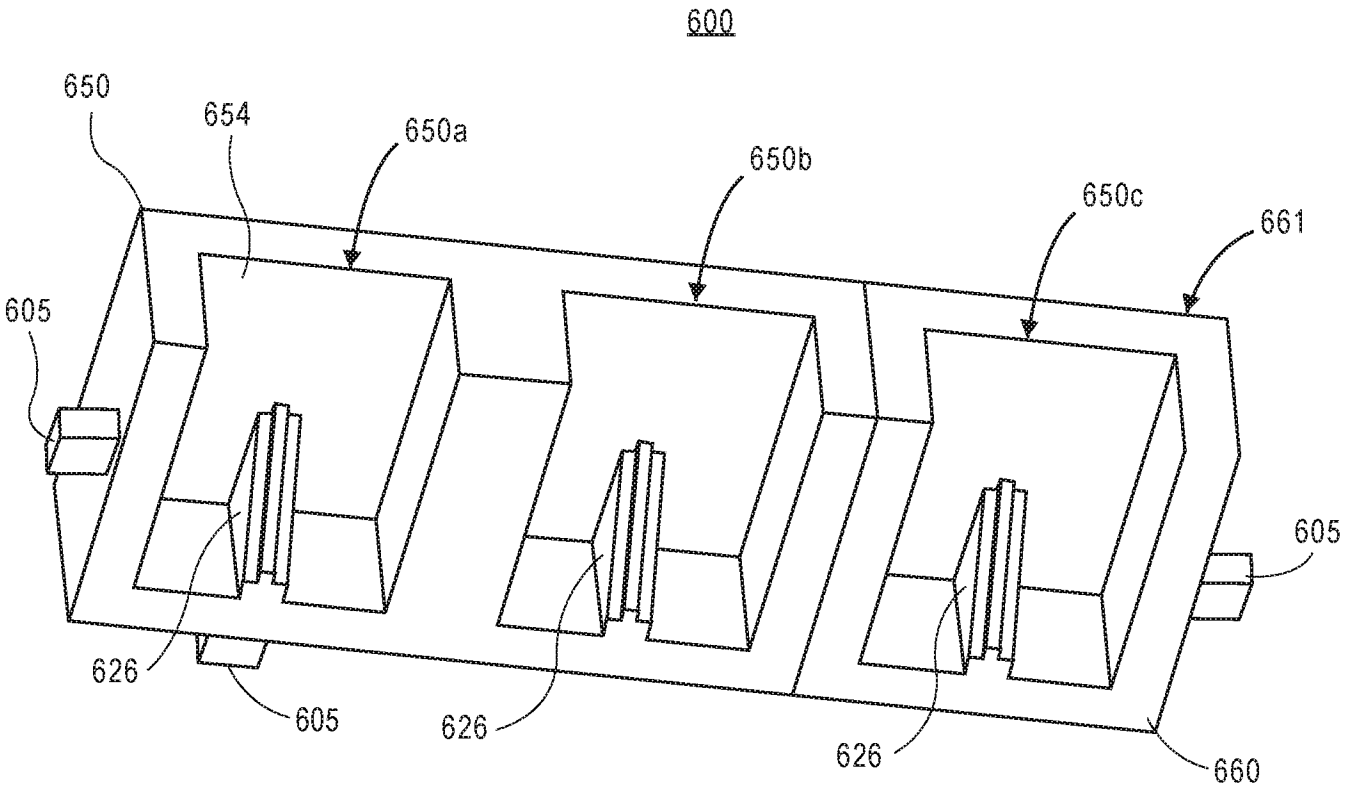
FIG. 6 is a perspective view of a waveguide launcher system that includes a waveguide connector having one or more compartments with one or more stepped tapers, according to one embodiment.

FIGS. 5A-5C illustrate a waveguide launcher system 500 having a package 530 and a waveguide connector 550 that uses one or more tapered slot launchers 520 for exciting one or more waveguides, according to some embodiments. Additionally, FIGS. 5A-5C illustrate a partially-integrated SMT waveguide connector 550 disposed on the package 530. The waveguide launcher system 500 may be similar to the waveguide launcher system 400 of FIGS. 4A-4C, but the partially-integrated SMT waveguide connector 550 is only integrated (or patterned/formed) with one or more taper slots 526 while the other components (e.g., the balun structures 518) are disposed/printed on a top surface layer 510 of the package 530. The waveguide launcher system 500 includes the partially-integrated SMT waveguide connector 550 with a waveguide launcher 520 and a taper 526. The waveguide launcher system 500 also includes the package 530 with a balun structure 518 on a top surface 510 of the package 530, where the balun structure 518 is disposed on the top surface 510 of the package 530 to form a slot-line signal converter 511, and the waveguide connector 550 is disposed on the top surface 510 of the package 530. The taper 526 of waveguide connector 552 may be disposed on the slot-line signal converter 511 of the package 530 and a terminal end 552 of the waveguide connector 550 to form a channel 521 and a tapered slot 522.

Note that similar assembly techniques (e.g., using solder, assembly pads, and/or conductive epoxy layers) as shown in FIG. 4C may be used with the waveguide launcher system 500 of FIGS. 5A-5C. Also note that each of the FIGS. 5A-5C highlights a component of the waveguide launcher system 500 (e.g., FIG. 5A shows the waveguide connector 550, FIG. 5B shows the package 530, and FIG. 5C shows the one or more layers, vias, and openings of the package 530.)

Referring now to FIG. 5A, a top, perspective view of the waveguide connector 550 of the waveguide launcher system 500 is illustrated. The waveguide connector 550 has one or more compartments 550*a-c* that may be used to excite one or more waveguides. The waveguide connector 550 may be similar to the waveguide connector 450 of FIGS. 4A-4C, but the waveguide connector 550 has a bottom surface 560 that is not integrated with the balun structures and the slot-line signal converter. Instead, as shown in FIG. 5B, the balun structure 518 is disposed on the top layer 510 of the package 530.

The waveguide connector 550 has the bottom surface 560 and a top surface 561. The bottom surface 560 may include the bottom surfaces of the tapers 526 and the external/internal walls of the waveguide connector 550. As noted above, each of the compartments 550*a-c* may be used as a separate waveguide connector, where each of the compartments 550*a-c* may have at least a tapered slot launcher. Each of the compartments 550*a-c* may be used to propagate a closed waveguide mode signal via a waveguide that may be communicatively coupled to an open end 554 formed in each of the compartments 550*a-c*. For some embodiments, the waveguide connector 550 may have one or more assembly pads 505 disposed on one or more exterior walls of the waveguide connector 550. The one or more assembly pads 505 may be used to align and electrically couple the waveguide connector 550, the balun structure 518, and the package 530.

Note that the waveguide launcher system 500 as shown in FIG. 5A may include fewer or additional packaging components based on the desired packaging design.

FIG. 5B is a top, perspective view of the package 530 of the waveguide launcher system 500. The package 530 has a microstrip feedline 540, a balun structure 518, and a top conductive layer 510. Note that one or more well-known features may be omitted or simplified in FIG. 5B in order not to obscure the illustrative implementations (e.g., a first layer or a solder mask that is optional may not be illustrated for simplicity). Likewise, for clarity and simplification, the package 530 shown in FIG. 5B may be used to accommodate one waveguide connector and/or one compartment (e.g., compartment 550*a* of the waveguide connector 550).

In one embodiment, the top conductive layer 510 is a GND plane layer. For one embodiment, the balun structure 518 is formed (or patterned/disposed) on the top conductive layer 510, which also forms a slot-line converter on the package 530. As such, the microstrip feedline 540 may feed a signal to the balun structure 518 on the slot-line converter. The slot-line converter of the package 530 may translate (and convert) the signal into a slot-line signal and transmit the slot-line signal to be aligned with or parallel to a z-axis. For one embodiment, the top conductive layer 510 may be disposed on or above the microstrip feedline 540. For another embodiment, the bottom surface 560 of the waveguide connector 550 (as shown in FIG. 5A) can be directly disposed on the top conductive layer 510 of the package 530, where the waveguide connector 550 may now be enclosed on each end except the one open end 554.

Note that the waveguide launcher system 500 as shown in FIG. 5B may include fewer or additional packaging components based on the desired packaging design.

FIG. 5C is a cross-sectional view of a portion of the package 530 of the waveguide launcher system 500. For one embodiment, the package 530 may include a first layer 512, a second layer 510, and one or more dielectric layers 507, according to one embodiment. The package 530 may be similar to the package 230 of FIG. 2D, but for this embodiment the package 530 is patterned for a waveguide connector (e.g., waveguide connector 550) that does not include a balun structure on the bottom surface of the connector (hence the balun structure is printed/patterned on the second layer 510 (or the top metal layer)).

As shown in FIG. 5C, the first layer 512 may be disposed on the second layer 510 and patterned to form an opening 514. The opening 514 of the first layer 512 is formed to couple the second layer 510 (the package GND) and the external walls of the waveguide connector (not shown) using a solder paste printing process, a conductive epoxy dispensing process, or any similar process. For one embodiment, the first layer 512 may be a solder mask, a resist layer, or any other dielectric layer. Note that the first layer 512 may be optional, as such the top surface of the package 530 is the second layer 210 according to this optional implementation.

For one embodiment, the first layer 512 and the second layer 510 are both patterned to form an opening 515 and a connector land 503. The opening 515 may be used and patterned (e.g., with a dumbbell-shaped opening) to implement a balun structure for a slot-line converter on the top surface of package 530. For one embodiment, the package 530 has one or more dielectric layers 507 surrounding (disposing and/or adjacent to) the one or more conductive layers, where the second layer 510 is the top conductive layer that forms the GND plane of the package 530. According to this embodiment, when using a partially-integrated SMT waveguide connector (e.g., the waveguide connector 550 of FIG. 5A that does not include a balun structure on the bottom surface of the connector 550), the package 530 may have the connector land 503 used as a surface area/location where the SMT waveguide connector may be disposed.

For example, the connector land 503 may be allotted a portion on the second layer 510 between an edge of the first layer 510 and a ground via wall 509, where the top pad of the ground via wall 509 is coupled to the second layer 510 and formed around the perimeter/outline of the waveguide connector to electrically couple to at least one or more conductive layers of the package 530. For another embodiment, the package 530 may have a different architecture (e.g., as shown in FIG. 2D) when the SMT connector does include a balun structure on the bottom surface (and hence the SMT connector is fully-integrated as the balun structure is formed/printed on the bottom surface of the SMT connector). In addition, the one or more assembly pads 505 of the waveguide connector 550 may be disposed on at least one or more openings 514 on the package 530 and then a reflow process may be used to electrically couple (and/or affix) the external surface wall(s) of the connector 550 to the package ground on the package 530.

Note that the waveguide launcher system 500 as shown in FIG. 5C may include fewer or additional packaging components based on the desired packaging design.

FIG. 6 is a perspective view of a waveguide launcher system 600 having a waveguide connector 650 that uses one or more tapered slot launchers for exciting one or more waveguides, according to some embodiments. The waveguide launcher system 600 illustrates a partially-integrated SMT waveguide connector 650 (such as the SMT waveguide connector 550 of FIG. 5A). The waveguide launcher system 600 may be similar to the waveguide launcher system 400 of FIGS. 4A-4C, but the partially-integrated SMT waveguide connector 650 is only integrated with one or more taper slots 626 while the other components (e.g., a balun structure) may be disposed on a top surface layer of a package. Likewise, the waveguide launcher system 600 may be similar to the waveguide launcher system 500 of FIGS. 5A-5C, but the partially-integrated SMT waveguide connector 650 includes a taper 626 that has a stepped taper shape used to optimize the performance and/or manufacturability of the waveguide launcher system 600. Note that similar assembly techniques (e.g., using solder, assembly pads, and/or conductive epoxy layers) as shown in FIG. 4C may be used with the waveguide launcher system 600.

As shown in FIG. 6, a bottom, perspective view of the waveguide connector 650 of the waveguide launcher system 600 is illustrated. The waveguide connector 650 has one or more compartments 650*a-c* that may be used to excite one or more waveguides. The waveguide connector 650 has a bottom surface 660 and a top surface 661. The bottom surface 660 may include the bottom surfaces of the tapers 626 and the external/internal walls of the waveguide connector 650. As noted above, each of the compartments 650*a-c* may be used as a separate waveguide connector, where each of the compartments 650*a-c* may have a tapered slot launcher with a stepped taper 626.

The stepped taper 626 may be pattered to have one or more stepped edges on the taper, where, for example, the outer stepped edges are patterned between one protruding inner step. Note that a stepped taper may have a plurality of steps (or edges). For example, as shown in FIG. 6, the stepped taper 626 has three steps but other embodiments may include more or less than three steps if needed. In addition, the waveguide connector 650 may have one or more different types of tapers (e.g., straight lines, exponential, quadratic, elliptical, double fin, etc.), including patterning one or more different types of tapers for at least one or more of the compartment 650*a-c* (i.e., compartment 650*a* may have a stepped taper, 650*b* may have a double fin taper, and 650*c* may have an elliptical taper).

Each of the compartments 650*a-c* may be used to propagate a closed waveguide mode signal via a waveguide that may be communicatively coupled to an open end 654 formed in each of the compartments 650*a-c*. For some embodiments, the waveguide connector 650 may have one or more assembly pads 605 disposed on one or more exterior walls of the waveguide connector 650. The one or more assembly pads 605 may be used to align and electrically couple the waveguide connector 650 to a package.

Note that the waveguide launcher system 600 may include fewer or additional packaging components based on the desired packaging design.

FIG. 7 is a cross-sectional view of a waveguide launcher system 700 including a package 730 with a top conductive layer 710 and a microstrip feedline 740, and a waveguide connector 750 with a slot-line signal converter 711, a balun structure 718, and a tapered slot launcher 720, according to one embodiment. The waveguide launcher system 700 may be similar to the waveguide launcher system 200 and of FIGS. 2-3, but the waveguide launcher system 700 has the tapered slot launcher 720, which includes two coplanar members (double fin taper slots or coplanar plates) a first member 724 physically and/or communicably coupled to a top surface of the slot-line signal converter 711 at a first location and a second member 726 also physically and/or communicably coupled to the top surface of the slot-line signal converter 711 at a second location. Also note that one or more well-known features may be omitted or simplified in order not to obscure the illustrative implementations.

In some embodiments, a planar first member 724 and a planar second member 726 are disposed co-planarly in a spaced arrangement to form a feed channel 721 and a tapered slot 722. In embodiments, the first member 724 may be physically and/or conductively coupled to the top surface of the slot-line signal converter 711 at a first location with respect to the balun structure 718 and the second member 726 may be physically and/or conductively coupled to the top surface of the slot-line signal converter 711 at a second location with respect to the balun structure 718. In such embodiments, the first location and the second location may be disposed in opposition across (e.g., on opposite sides of) the balun structure 718.

The first member 724 and the second member 726 may be planar members that are disposed co-planar to each other (i.e., the first member 724 and the second member 726 may lay or otherwise fall in the same plane) to form a double fin tapered slot launcher 720 inside the waveguide connector 750. The first edge of the first member 724 may be disposed proximate the top surface of the slot-line signal converter 711. The first edge of the first member 724 may be physically and/or conductively coupled to the top surface of the slot-line signal converter 711. The second edge of the first member 724 may form at least a portion of a border, boundary, or periphery of the tapered slot 722. Respectively, the first edge of the second member 726 may be disposed proximate the waveguide connector 750. The first edge of the second member 726 may be physically and/or conductively coupled to the waveguide connector 750. The second edge of the second member 726 may form at least a portion of a border, boundary, or periphery of the tapered slot 722.

In such embodiments, the second edge of the first member 724 and the second edge of the second member 726 form a tapered slot 722. The second edge of the first member 724 and the second edge of the second member 726 may extend at an angle such that at a first end of the tapered slot 722 the second edges are disposed relatively closer to each other than at an opposed second end of the tapered slot 722, where the second edges are disposed relatively distant from each other (i.e., the tapered angle of the tapered slot 722 is smaller the closer the second edges of the first and second members 724 and 726 are to a feed channel 721. In embodiments, the first member 724 and the second member 726 forming the tapered slot launcher 720 are grounded to a ground plane of the package 730 via the waveguide connector 750, which is disposed on the top conductive layer 710 (package GND) of the package 730. In other embodiments, the first member 724 and the second member 726 forming the tapered slot launcher 720 may be coupled directly or indirectly to the ground plane of the package 730.

In some embodiments, the second edge of the second member 724 and/or the second edge of the second member 726 may include, but is not limited to, a straight edge, a stepped edge, a curved edge, an elliptical edge, or an arcuate edge. The distance between the first member 724 and the second member 726 may, in some embodiments, be based in whole or in part on the frequency and/or frequency band of a closed waveguide mode signal transmitted by the tapered slot launcher 720.

According to some embodiments, all or a portion of the first member 724 and/or all or a portion of the second member 726 may be formed integral with the top surface forming the slot-line signal converter 711. In one embodiment, the first member 724 and the second member 726 extend at an angle of from about 45° to about 90° from the top surface of the slot-line signal converter 711, measured with respect to the top surface of the slot-line signal converter 711. In some embodiments, the overall physical dimensions of the first member 724 and the second member 726 may be based, in whole or in part, on the frequency or frequency band of the closed waveguide mode signal transmitted by the tapered slot launcher 720.

For one embodiment, the waveguide launcher system 700 has a fully-integrated SMT waveguide connector/component 750 that can be assembled and disposed on the package 730 using standard PCB assembly techniques. The fully-integrated SMT waveguide connector 750 may include the tapered slot launcher 720 disposed in, on, or about at least a portion of the interior enclosure of the waveguide connector 750, and the slot-line signal converter 711 with the balun structure 718 also disposed in, on, or about the bottom surface of the waveguide connector 750.

In some embodiments, the first and second members 724 and 725 of the tapered slot launcher 720 and the slot-line signal converter 711 are disposed in a spaced arrangement to form a feed channel 721. The feed channel 721 aligns with a central portion of the balun structure 718 of the slot-line signal converter 711 and receives a microstrip signal from the microstrip feedline 740, which terminates at a connection point 719. The slot-line signal converter 711 then converts the microstrip signal to a slot-line mode signal using the balun structure 718 and transmits the slot-line mode signal via the feed channel 721. The tapered slot launcher 720 transitions the axis of propagation of the slot-line mode signal provided by the feed channel 721 to a different axis of propagation toward the tapered slot 722 of the waveguide connector 7. The tapered slot launcher 720 has the tapered slot 722 that is formed with the coplanar members 724 and 726. The tapered slot launcher 720 converts the slot-line mode signal fed by the channel 721 to the closed waveguide mode signal that propagates along a waveguide (not shown). In some embodiments, the coplanar members 724 and 726 of the tapered slot launcher 720 may be electrically isolated from each other using, e.g., a thin insulator, a dielectric layer, or a similar material.

Note that the waveguide launcher system 700 may include fewer or additional packaging components based on the desired packaging design.

Figure 8:
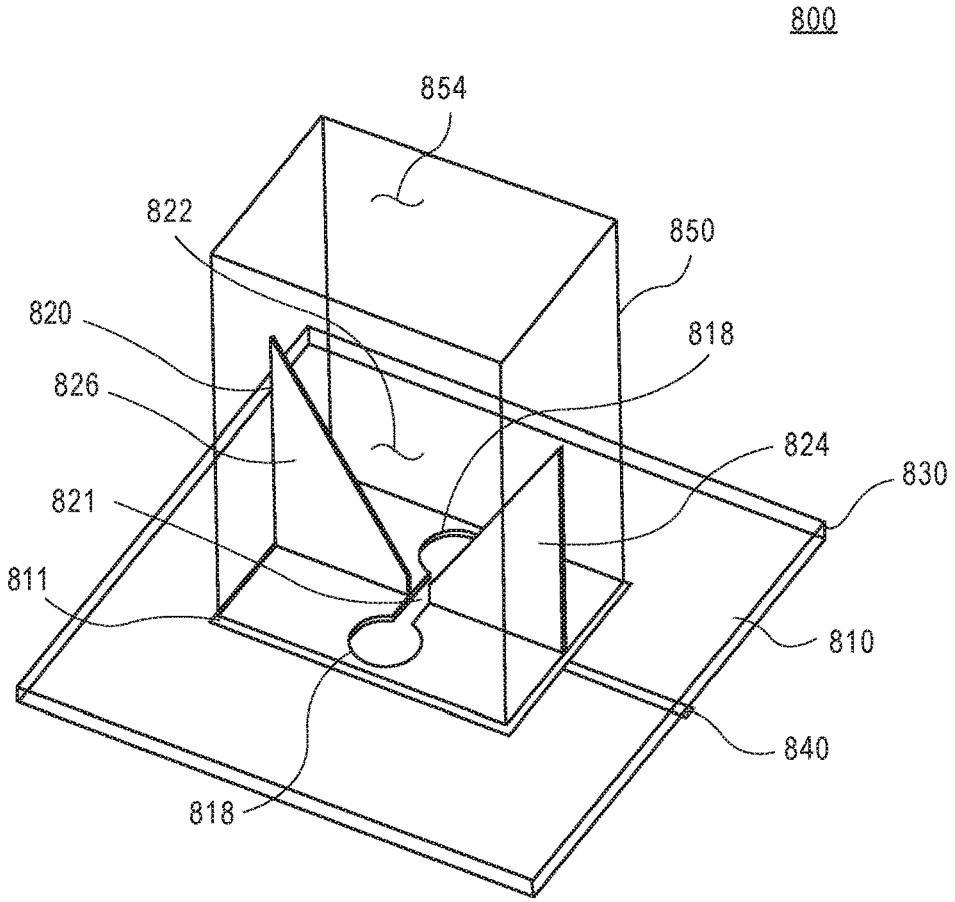
FIG. 8 is a perspective view of a vertical waveguide launcher system that includes a package having a top conductive layer and a microstrip feedline, and a waveguide connector having a slot-line signal converter, a balun structure, and a mirrored tapered slot launcher, according to one embodiment.

FIG. 8 is a perspective view of a vertical waveguide launcher system 800 including a package 830 with a top conductive layer 810 and a microstrip feedline 840, and a waveguide connector 850 with a slot-line signal converter 811, a balun structure 818, and a tapered slot launcher 820, according to one embodiment. The waveguide launcher system 800 may be similar to the waveguide launcher system 200 and of FIGS. 2-3, but the waveguide launcher system 800 can be used to excite an open dielectric waveguide (not shown) by mirroring the tapers 824 and 826 of the tapered slot launcher 820 around one of the axis. For one embodiment, the vertical waveguide launcher system 800 may be used only with dielectric waveguides.

The vertical waveguide launcher system 800 can also be used to excite circular waveguides by changing the shape of the package 830 from rectangular to circular. The waveguide connector 850 may be a fully-integrated SMT component that includes the balun structure 818 disposed on a bottom surface of the connector 850, where the bottom surface is opposite to an open end 854 of the connector 850. The waveguide connector 850 also has the tapered slot launcher 820 that includes two mirrored tapers 824 and 826, where the exposed edges of the mirrored tapers 824 and 826 form a feed channel 821 and a tapered slot 822. The taper 824 is disposed on opposite ends from the taper 826, and the bottom surfaces of the tapers 824 and 826 are separated by the balun structure 818 and a feed channel 821.

The waveguide connector 850 has the slot-line signal converter 811 which includes the balun structure 818. The slot-line signal converter 811 has a top surface and a bottom surface. The tapers 824 and 826 are disposed on the top surface of the slot-line signal converter 811, while the bottom surface of the slot-line signal converter 811 is disposed on the top conductive layer 810 on the package 830. The package 830 includes the microstrip feedline 840 to transmit a signal from a source to the slot-line signal converter 811.

Note that the waveguide launcher system 800 may include fewer or additional packaging components based on the desired packaging design.

FIG. 9 is a perspective view of a vertical waveguide launcher system 900 including a package 930 with a top conductive layer 910 and one or more microstrip feedlines 940, and a waveguide connector 950 with one or more compartments 950*a-f*, one or more slot-line signal converters 911, one or more balun structures 918, and one or more tapered slot launchers 920, according to one embodiment. The waveguide launcher system 900 may be similar to the waveguide launcher system 200 and of FIGS. 2-3, but the waveguide launcher system 900 can be used to excite/feed one or more waveguides (not shown) by having the waveguide connector 950 arrayed along one or two dimensions.

The vertical waveguide connector 950 includes the compartments 950*a-f*, where each of the compartments 950*a-f* has an individual tapered slot launcher 920 with an open end 954. The vertical waveguide connector 950 may be a fully-integrated SMT component that is disposed on the top conductive layer 910 of the package 930. As shown in FIG. 9, a plurality of vias 909 (collectively, "vias 909") may conductively couple the slot-line signal converters 911 and/or the waveguide connector 950 to a ground plane (e.g., the top conductive layer 910) on or within the package 930. In some embodiments, the vias 910 communicably couple to the top conductive layer 910 of the package 930 and extend about all or a portion of the perimeter of the slot-line signal converters 911 of the waveguide connector 950.

Note that the waveguide launcher system 900 may include fewer or additional packaging components based on the desired packaging design.

Figure 10B:
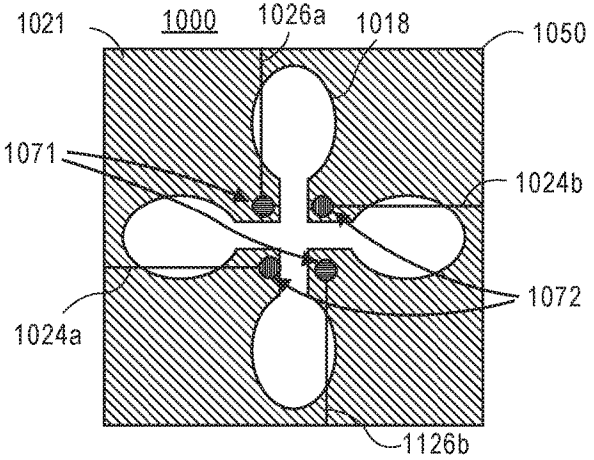
FIG. 10B is a plan view of a vertical waveguide launcher system with a waveguide connector, one or more tapers, and one or more balun structures, according to one embodiment.
Figure 11B:
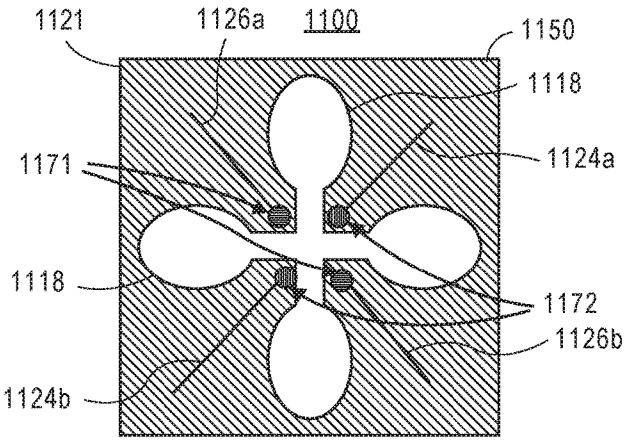
FIG. 11B is a plan view of a vertical waveguide launcher system with a waveguide connector, one or more tapers, and one or more balun structures, according to one embodiment.
Figure 10A:
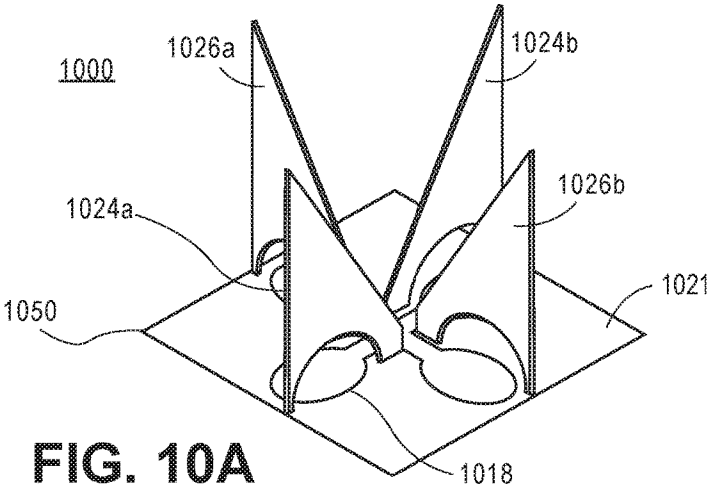
FIG. 10A is a perspective view of a vertical waveguide launcher system with a waveguide connector, one or more tapers, and one or more balun structures, according to one embodiment.
Figure 11A:
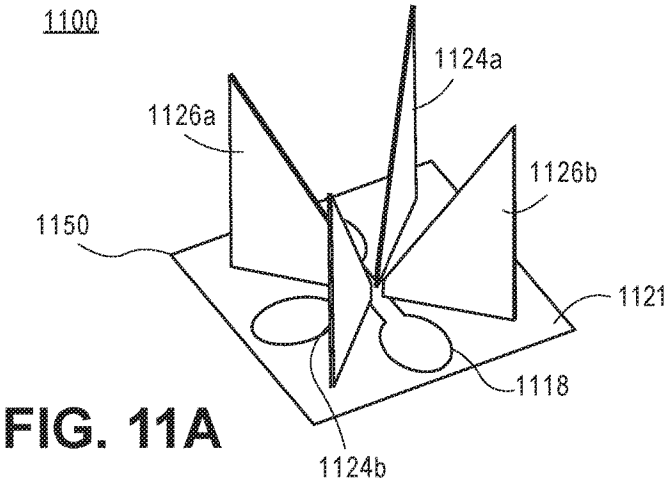
FIG. 11A is a perspective view of a vertical waveguide launcher system with a waveguide connector, one or more tapers, and one or more balun structures, according to one embodiment.

FIGS. 10A-10B and 11A-11B have one or more waveguide launcher systems 1000 and 1100 that illustrate one or more different ways to convert the feed from a single polarization to multiple polarizations. FIG. 10A is a perspective view of the waveguide launcher system 1000, and FIG. 10B is the plan view of the waveguide launcher system 1000. Likewise, FIG. 11A is a perspective view of the waveguide launcher system 1100, and FIG. 11B is the plan view of the waveguide launcher system 1100. For some embodiments, the waveguide launcher systems 1000 and 1100 may need multiple polarizations. As shown in FIGS. 10-11, each of the waveguide launcher systems 1000 and 1100 may include waveguide connectors 1050 and 1150 and slot-line signal converters 1021 and 1121, respectively.

In some embodiments, the waveguide launcher system 1000 of FIGS. 10A-10B may have a feed structure (or a tapered slot launcher) that can be rotated by 90 degrees to enable a dual polarization operation. For example, as shown in FIG. 10B, the waveguide launcher system 1000 includes feed points 1071 having vertical polarizations and feed points 1072 having horizontal polarizations. For one embodiment, as shown in FIGS. 10A-10B, the waveguide launcher system 1000 may have offsetting tapers 1024*a-b* and 1026*a-b* to avoid shorting and perforating the tapers (or fins) to avoid the balun structures 1018. Alternatively, the waveguide launcher system 1100 of FIGS. 11A-11B may have the tapers 1124*a-b* and 1126*a-b* rotated by 45 degrees to generate a plus/minus (+/−) 45 degrees polarization. For example, as shown in FIG. 11B, the waveguide launcher system 1100 includes feed points 1171 having −45 degrees polarization and feed points 1172 having 45 degrees polarization. For one embodiment, as shown in FIGS. 11A-11B, the waveguide launcher system 1100 may have mirrored tapers 1124*a-b* and 1126*a-b* to avoid the balun structures 1118.

Note that the waveguide launcher systems 1000 and 1100 as shown in FIGS. 10A-10B and 11A-11B may include fewer or additional packaging components based on the desired packaging design.

Figure 12:
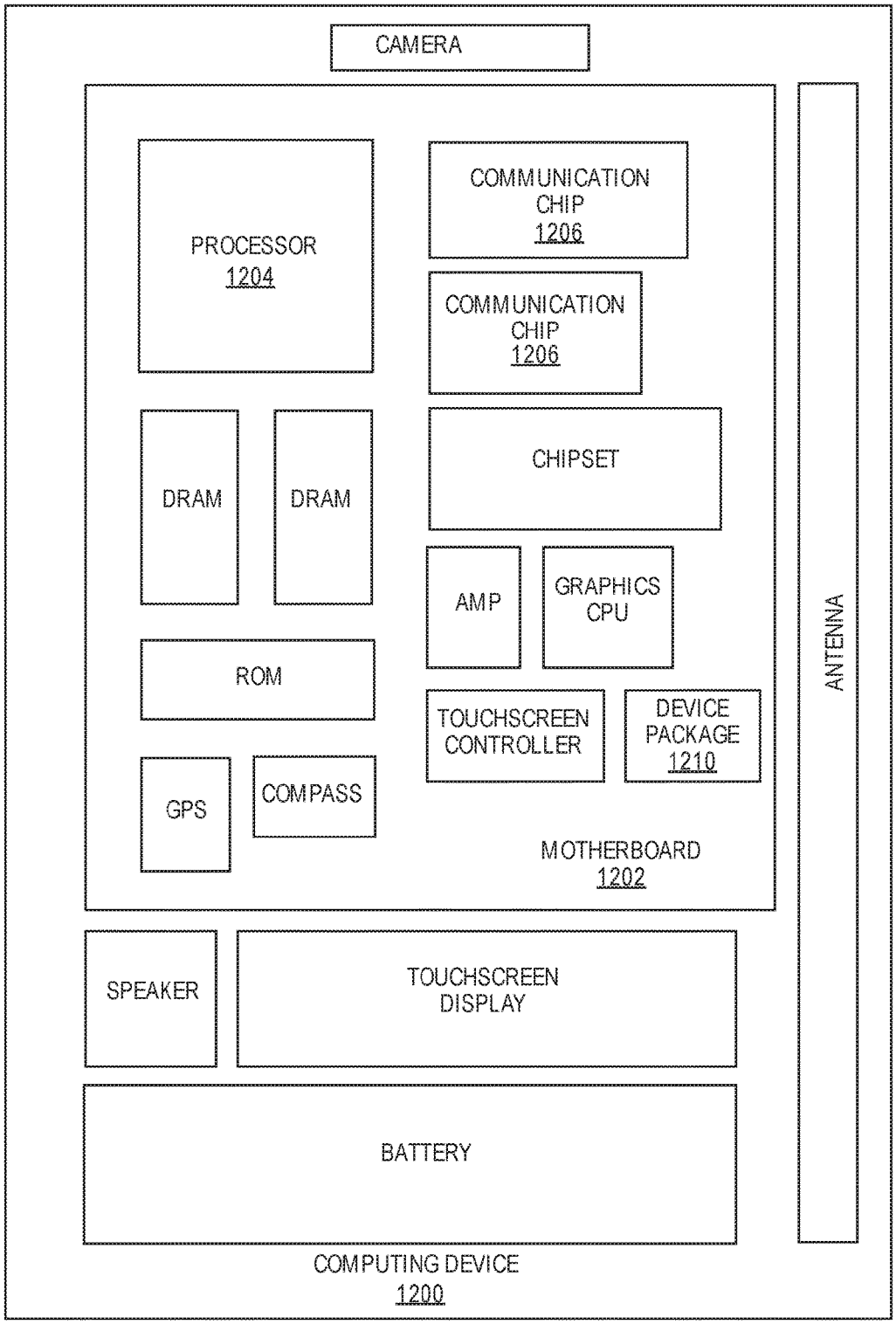
FIG. 12 is a schematic block diagram illustrating a computer system that utilizes a device package with one or more waveguide launcher systems, according to one embodiment.

FIG. 12 is a schematic block diagram illustrating a computer system 1200 that utilizes a device package 1210 with one or more waveguide launcher systems, according to one embodiment. FIG. 12 illustrates an example of computing device 1200. Computing device 1200 houses motherboard 1202. For one embodiment, motherboard 1202 may be similar to the packages of FIGS. of 2-5 and 8-9 (e.g., packages 230, 430, 530, 830 and 930 of FIGS. 2-5 and 8-9). Motherboard 1202 may include a number of components, including but not limited to processor 1204, package 1210 (or crimped connector package/system), and at least one communication chip 1206. Processor 1204 is physically and electrically coupled to motherboard 1202. For some embodiments, at least one communication chip 1206 is also physically and electrically coupled to motherboard 1202. For other embodiments, at least one communication chip 1206 is part of processor 1204.

Depending on its applications, computing device 1200 may include other components that may or may not be physically and electrically coupled to motherboard 1202. These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

At least one communication chip 1206 enables wireless communications for the transfer of data to and from computing device 1200. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. At least one communication chip 1206 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. Computing device 1200 may include a plurality of communication chips 1206. For instance, a first communication chip 1206 may be dedicated to shorter range wireless communications such as Wi-Fi and Bluetooth and a second communication chip 1206 may be dedicated to longer range wireless communications such as GPS, EDGE, GPRS, CDMA, WiMAX, LTE, Ev-DO, and others.

Processor 1204 of computing device 1200 includes an integrated circuit die packaged within processor 1204. Device package 1210 may be, but is not limited to, a packaging substrate, a PCB, and a motherboard. Device package 1210 has a waveguide launcher system with a packaging having a microstrip feedline and one or more conductive layers, and a waveguide connector having a slot-line signal converter, one or more balun structures, and one or more tapered slot launchers, and the like—or any other components from the figures described herein—of the computing device 1200. Device package 1210 includes a waveguide launcher system that has a power-competitive solution that can support very high data rates, e.g., over short to medium distances, which would be extremely advantageous for interconnects within server and HPC architectures and/or autonomous/self-driving vehicles, according to some embodiments. Furthermore, device package 1210 includes tapered-slot launchers and connectors for exciting the waveguides which facilitates an improvement in the manufacturing and assembly of waveguide interconnect systems. Device package 1210 provides a tapered-slot waveguide launcher and connector enabling a wider bandwidth for thin package substrates as the demand for miniaturization persistently increases, and a decreased sensitivity to waveguide alignment and electrical contacts.

Note that device package 1210 may be a single component/device, a subset of components, and/or an entire system, as the materials, features, and components may be limited to device package 1210 and/or any other component that needs a waveguide launcher system.

For certain embodiments, the integrated circuit die may be packaged with one or more devices on a package substrate that includes a thermally stable RFIC and antenna for use with wireless communications and the device package, as described herein, to reduce the z-height of the computing device. The term "processor" may refer to any device or portion of a device that processes electronic data from registers and/or memory to transform that electronic data into other electronic data that may be stored in registers and/or memory.

At least one communication chip 1206 also includes an integrated circuit die packaged within the communication chip 1206. For some embodiments, the integrated circuit die of the communication chip may be packaged with one or more devices on a package substrate that includes one or more device packages, as described herein.

In the foregoing specification, embodiments have been described with reference to specific exemplary embodiments thereof. It should be borne in mind, however, that all of these and similar terms are to be associated with the appropriate physical quantities and are merely convenient labels applied to these quantities. It will be evident that various modifications may be made thereto without departing from the broader spirit and scope. The specification and drawings are, accordingly, to be regarded in an illustrative sense rather than a restrictive sense.

The following examples pertain to further embodiments. The various features of the different embodiments may be variously combined with some features included and others excluded to suit a variety of different applications.

The following examples pertain to further embodiments:

Example 1 is a waveguide launcher and connector, comprising a waveguide connector with a waveguide launcher, a taper, and a slot-line signal converter; and a balun structure on the slot-line signal converter. The taper is disposed on the slot-line signal converter and a terminal end of the waveguide connector to form a channel and a tapered slot.

In example 2, the subject matter of example 1 can optionally include a package having one or more layers, a line, and a radial stub. The line is on a layer of the package, the line is a microstrip feedline, and the line terminates at the radial stub; the waveguide connector having one or more assembly pads on one or more external walls of the waveguide connector; the waveguide connector on a top surface of the package. At least one of the assembly pads and the external walls of the waveguide connector are electrically coupled to the top surface of the package; and a waveguide coupled to the waveguide connector.

In example 3, the subject matter of any of examples 1-2 can optionally include the waveguide launcher includes a single layer resonant patch launcher, a stacked-patch launcher, a tapered slot launcher, a leaky-wave launcher, or a microstrip-to-slot transition launcher.

In example 4, the subject matter of any of examples 1-3 can optionally include the balun structure which includes one or more shaped openings. The one or more shaped openings include a dumbbell-shaped structure and a double-lobed structure. The one or more shaped openings include a circular opening, a rectangular opening, a wedge-shaped opening, a hexagonal opening, a semi-circular opening, a semi-rectangular opening, a semi-polygonal opening, and a semi-hexagonal opening.

In example 5, the subject matter of any of examples 1-4 can optionally include the waveguide connector having one or more inner walls. The one or more inner walls include the terminal end, a top surface, and a bottom surface that is opposite of the top surface. The bottom surface of the waveguide connector forms the slot-line signal converter.

In example 6, the subject matter of any of examples 1-5 can optionally include the taper which includes at least one of a straight line taper, a stepped taper, a double fin taper, an exponential taper, a quadratic taper, and an elliptical taper.

In example 7, the subject matter of any of examples 1-6 can optionally include the balun structure receiving a signal from the microstrip feedline of the package and converts the signal to a slot-line signal. The waveguide launcher converts the slot-line signal to a closed waveguide mode signal with the taper. The waveguide launcher emits the closed waveguide mode signal along the channel and propagates the closed waveguide mode signal along the taper slot of the waveguide launcher to the waveguide coupled to the waveguide connector.

In example 8, the subject matter of any of examples 1-7 can optionally include the waveguide connector further includes one or more compartments. Each of the compartments includes a balun structure, a waveguide launcher, a taper, and a slot-line signal converter.

In example 9, the subject matter of any of examples 1-8 can optionally include the waveguide is at least one of a metallic waveguide and a dielectric waveguide.

Example 10 is a method of forming a waveguide launcher and connector, comprising disposing a waveguide launcher, a taper, and a slot-line signal converter on a waveguide connector; and disposing a balun structure on the slot-line signal converter. The taper is disposed on the slot-line signal converter and a terminal end of the waveguide connector to form a channel and a tapered slot.

In example 11, the subject matter of example 10 can optionally include disposing one or more layers, a line, and a radial stub on a package. The line is on a layer of the package, the line is a microstrip feedline, and the line terminates at the radial stub; disposing one or more assembly pads on one or more external walls of the waveguide connector; disposing the waveguide connector on a top surface of the package. At least one of the assembly pads and the external walls of the waveguide connector are electrically coupled to the top surface of the package; and coupling a waveguide to the waveguide connector.

In example 12, the subject matter of any of examples 10-11 can optionally include the waveguide launcher which includes a single layer resonant patch launcher, a stacked-patch launcher, a tapered slot launcher, a leaky-wave launcher, or a microstrip-to-slot transition launcher.

In example 13, the subject matter of any of examples 10-12 can optionally include the balun structure which includes one or more shaped openings. The one or more shaped openings include a dumbbell-shaped structure and a double-lobed structure. The one or more shaped openings include a circular opening, a rectangular opening, a wedge-shaped opening, a hexagonal opening, a semi-circular opening, a semi-rectangular opening, a semi-polygonal opening, and a semi-hexagonal opening.

In example 14, the subject matter of any of examples 10-13 can optionally include the waveguide connector having one or more inner walls The one or more inner walls include the terminal end, a top surface, and a bottom surface that is opposite of the top surface. The bottom surface of the waveguide connector forms the slot-line signal converter.

In example 15, the subject matter of any of examples 10-14 can optionally include the taper which includes at least one of a straight line taper, a stepped taper, a double fin taper, an exponential taper, a quadratic taper, and an elliptical taper.

In example 16, the subject matter of any of examples 10-15 can optionally include converting a signal from the microstrip feedline of the package to a slot-line signal with the balun structure; converting the slot-line signal to a closed waveguide mode signal with the taper of the waveguide launcher; emitting the closed waveguide mode signal along the channel of the waveguide launcher; and propagating the closed waveguide mode signal along the taper slot of the waveguide launcher to the waveguide coupled to the waveguide connector.

In example 17, the subject matter of any of examples 10-16 can optionally include the waveguide connector further including one or more compartments. Each of the compartments includes a balun structure, a waveguide launcher, a taper, and a slot-line signal converter.

In example 18, the subject matter of any of examples 10-17 can optionally include the waveguide is at least one of a metallic waveguide and a dielectric waveguide.

Example 19 is a waveguide launcher and connector, comprising a waveguide connector with a waveguide launcher and a taper; and a package with a balun structure on a top surface of the package. The balun structure is disposed on the top surface of the package to form a slot-line signal converter. The waveguide connector is disposed on the slot-line signal converter and the top surface of the package.

In example 20, the subject matter of example 19 can optionally include the taper of waveguide connector is disposed on the slot-line signal converter of the package and a terminal end of the waveguide connector to form a channel and a tapered slot; the package having one or more layers, a line, and a radial sub. The line is on a layer of the package, the line is a microstrip feedline, and the line terminates at the radial stub; the waveguide connector having one or more assembly pads on one or more external walls of the waveguide connector. At least one of the assembly pads and the external walls of the waveguide connector are electrically coupled to the top surface of the package; and a waveguide coupled to the waveguide connector. The waveguide is at least one of a metallic waveguide and a dielectric waveguide.

In example 21, the subject matter of any of examples 19-20 can optionally include the waveguide launcher includes a single layer resonant patch launcher, a stacked-patch launcher, a tapered slot launcher, a leaky-wave launcher, or a microstrip-to-slot transition launcher.

In example 22, the subject matter of any of examples 19-21 can optionally include the balun structure which includes one or more shaped openings pattered on the top surface of the package. The one or more shaped openings include a dumbbell-shaped structure and a double-lobed structure. The one or more shaped openings include a circular opening, a rectangular opening, a wedge-shaped opening, a hexagonal opening, a semi-circular opening, a semi-rectangular opening, a semi-polygonal opening, and a semi-hexagonal opening.

In example 23, the subject matter of any of examples 19-22 can optionally include the waveguide connector having one or more inner walls. The one or more inner walls include the terminal end and a top surface. A top surface of the slot-line signal converter forms a bottom surface for the waveguide connector disposed on the package.

In example 24, the subject matter of any of examples 19-23 can optionally include the taper includes at least one of a straight line taper, a stepped taper, a double fin taper, an exponential taper, a quadratic taper, and an elliptical taper. The waveguide connector further includes one or more compartments. Each of the compartments includes at least one of a waveguide launcher and a taper.

In example 25, the subject matter of any of examples 19-24 can optionally include the balun structure receives a signal from the microstrip feedline of the package and converts the signal to a slot-line signal. The waveguide launcher converts the slot-line signal to a closed waveguide mode signal with the taper. The waveguide launcher emits the closed waveguide mode signal along the channel and propagates the closed waveguide mode signal along the taper slot of the waveguide launcher to the waveguide coupled to the waveguide connector.

In the foregoing specification, methods and apparatuses have been described with reference to specific exemplary embodiments thereof. It will be evident that various modifications may be made thereto without departing from the broader spirit and scope. The specification and drawings are, accordingly, to be regarded in an illustrative sense rather than a restrictive sense.

What is claimed is:

1. A waveguide launcher and connector, comprising: a waveguide connector with an enclosure compartment, wherein the waveguide connector includes a top wall a bottom wall and a plurality of sidewalls, and wherein the waveguide connector includes a waveguide launcher, a taper, and a slot-line signal converter that are in the enclosure compartment: and a balun structure on the slot-line signal converter, wherein the bottom wall of the enclosure compartment of the waveguide connector includes the balun structure and the slot-line signal converter, wherein the taper is disposed on the slot-line signal converter and a terminal end of the waveguide connector to form a channel and a tapered slot, and wherein the waveguide launcher, the taper, the slot-line signal converter, the balun structure, the channel, and then tapered slot are coupled to the enclosure compartment of the waveguide connector as a monolithic device.

2. The waveguide launcher and connector of claim 1, further comprising:

a package having one or more layers and a line, wherein the line is on a layer of the package, wherein the line includes at least one of a microstrip feedline, a grounded coplanar waveguide (GCPW) line, a coplanar waveguide (CPW) line, or a stripline, wherein the line terminates at a connection point, and wherein the connection point includes at least one of a radial stub, a conductive stub, a circular stub, a semi-circular stub, or a semi-rectangular stub;

the waveguide connector having one or more assembly pads on one or more external walls of the enclosure compartment of the waveguide connector;

the waveguide connector on a top surface of the package, wherein at least one of the assembly pads and the external walls of the enclosure compartment of the waveguide connector are electrically coupled to the top surface of the package; and a waveguide coupled to the enclosure compartment of the waveguide connector, wherein the enclosure compartment has an opening, and wherein the opening is sized to receive the waveguide.

3. The waveguide launcher and connector of claim 1, wherein the waveguide launcher includes at least one of a single layer resonant patch launcher, a stacked-patch launcher, a tapered slot launcher, a leaky-wave launcher, or a microstrip-to-slot transition launcher.

4. The waveguide launcher and connector of claim 1, wherein the balun structure includes one or more shaped openings, wherein the balun structure includes at least one of a dumbbell-shaped structure or a double-lobed structure, and wherein the one or more shaped openings include at least one of a circular opening, a rectangular opening, a wedge-shaped opening, a hexagonal opening, a semi-circular opening, a semi-rectangular opening, a semi-polygonal opening, or a semi-hexagonal opening.

5. The waveguide launcher and connector of claim 1, wherein the enclosure compartment of the waveguide connector has one or more inner walls, wherein the one or more inner walls include the terminal end, a top surface, and a bottom surface that is opposite of the top surface, and wherein the bottom surface of the inners walls of the waveguide connector forms includes the balun structure and the slot-line signal converter.

6. The waveguide launcher and connector of claim 1, wherein the taper includes at least one of a straight line taper, a stepped taper, a double fin taper, an exponential taper, a quadratic taper, or an elliptical taper.

7. The waveguide launcher and connector of claim 2, wherein the balun structure receives a signal from the microstrip feedline of the package and converts the signal to a slot-line signal, wherein the waveguide launcher converts the slot-line signal to a closed waveguide mode signal with the taper, and wherein the waveguide launcher emits the closed waveguide mode signal along the channel, and wherein the waveguide launcher propagates the closed waveguide mode signal along the taper slot of the waveguide launcher towards the opening of the enclosure compartment of the waveguide connector and to the waveguide coupled to the waveguide connector.

8. The waveguide launcher and connector of claim 1, wherein the waveguide connector further includes a plurality of enclosure compartments, and wherein the plurality of enclosure compartments include a plurality of balun structures, a plurality of waveguide launchers, a plurality of tapers, and a plurality of slot-line signal converters.

9. The waveguide launcher and connector of claim 2, wherein the waveguide is at least one of a metallic waveguide or a dielectric waveguide.

10. A method of forming a waveguide launcher and connector, comprising: disposing a waveguide connector with an enclosure compartment, wherein the waveguide connector includes a top wall, a bottom wall, and a plurality of sidewalls, and wherein the waveguide connector includes a waveguide launcher, a taper, and a slot-line signal converter that are in the enclosure compartment; and disposing a balun structure on the slot-line signal converter, wherein the bottom wall of the enclosure compartment of the waveguide connector includes the balun structure and the slot line signal converter, wherein the taper is disposed on the slot-line signal converter and a terminal end of the waveguide connector to form a channel and a tapered slot, and wherein the waveguide launcher, the taper, the slot-line signal converter, the balun structure, the channel and the tapered slot are coupled to the enclosure compartment of the waveguide connector to form a monolithic device.

11. The method of claim 10, further comprising:

disposing one or more layers and a line on a package, wherein the line is on a layer of the package, wherein the line includes at least one of a microstrip feedline, a GCPW line, a CPW line, or a stripline, wherein the line terminates at a connection point, and wherein the connection point includes at least one of a radial stub, a conductive stub, a circular stub, a semi-circular stub, or a semi-rectangular stub;

disposing one or more assembly pads on one or more external walls of the enclosure compartment of the waveguide connector;

disposing the waveguide connector on a top surface of the package, wherein at least one of the assembly pads and the external walls of the enclosure compartment of the waveguide connector are electrically coupled to the top surface of the package; and coupling a waveguide coupled to the enclosure compartment of the waveguide connector, wherein the enclosure compartment has an opening, and wherein the opening is sized to receive the waveguide.

12. The method of claim 10, wherein the waveguide launcher includes at least one of a single layer resonant patch launcher, a stacked-patch launcher, a tapered slot launcher, a leaky-wave launcher, or a microstrip-to-slot transition launcher.

13. The method of claim 10, wherein the balun structure includes one or more shaped openings, wherein the balun structure includes at least one of a dumbbell-shaped structure or a double-lobed structure, and wherein the one or more shaped openings include at least one of a circular opening, a rectangular opening, a wedge-shaped opening, a hexagonal opening, a semi-circular opening, a semi-rectangular opening, a semi-polygonal opening, or a semi-hexagonal opening.

14. The method of claim 10, wherein the enclosure compartment of the waveguide connector has one or more inner walls, wherein the one or more inner walls include the terminal end, a top surface, and a bottom surface that is opposite of the top surface, and wherein the bottom surface of the inners walls of the waveguide connector includes the balun structure and the slot-line signal converter.

15. The method of claim 10, wherein the taper includes at least one of a straight line taper, a stepped taper, a double fin taper, an exponential taper, a quadratic taper, or an elliptical taper.

16. The method of claim 11, further comprising: converting a signal from the microstrip feedline of the package to a slot-line signal with the balun structure; converting the slot-line signal to a closed waveguide mode signal with the taper of the waveguide launcher; emitting the closed waveguide mode signal along the channel of the waveguide launcher; and propagating the closed waveguide mode signal along the taper slot of the waveguide launcher towards the opening of the enclosure compartment of the waveguide connector and to the waveguide.

17. The method of claim 10, wherein the waveguide connector further includes a plurality of enclosure compartments, and wherein the plurality of enclosure compartments include a plurality of balun structures, a plurality of waveguide launchers, a plurality of tapers, and a plurality of slot-line signal converters.

18. The method of claim 11, wherein the waveguide is at least one of a metallic waveguide or a dielectric waveguide.

19. A waveguide launcher and connector, comprising: a waveguide connector with an enclosure compartment, wherein the waveguide connector includes a top wall and a plurality of sidewalls, and wherein the waveguide connector includes a waveguide launcher and a taper that are in the enclosure compartment: and a package with a balun structure on a top surface of the package, wherein the balun structure is disposed on the top surface of the package to form a slot-line signal converter, wherein the top surface of the package includes the balun structure and the slot-line signal converter, wherein the waveguide launcher and the taper are coupled to the enclosure compartment of the waveguide connector as a monolithic device, and wherein the enclosure compartment of the waveguide connector is disposed on over the balun structure and the slotline signal converter of the top surface of the package.

20. The waveguide launcher and connector of claim 19, further comprising:

the taper of the waveguide connector is disposed on the slot-line signal converter of the package and a terminal end of the waveguide connector to form a channel and a tapered slot;

the package having one or more layers and a line, wherein the line is on a layer of the package, wherein the line includes at least one of a microstrip feedline, a GCPW line, a CPW line, or a stripline, wherein the line terminates at a connection point, and wherein the connection point includes at least one of a radial stub, a conductive stub, a circular stub, a semi-circular stub, or a semi-rectangular stub;

the waveguide connector having one or more assembly pads on one or more external walls of the enclosure compartment of the waveguide connector, wherein at least one of the assembly pads and the external walls of the enclosure compartment of the waveguide connector are electrically coupled to the top surface of the package; and a waveguide coupled to the enclosure compartment of the waveguide connector, wherein the enclosure compartment has an opening, wherein the opening is sized to receive the waveguide, and wherein the waveguide is at least one of a metallic waveguide or a dielectric waveguide.

21. The waveguide launcher and connector of claim 19, wherein the waveguide launcher includes at least one of a single layer resonant patch launcher, a stacked-patch launcher, a tapered slot launcher, a leaky-wave launcher, or a microstrip-to-slot transition launcher.

22. The waveguide launcher and connector of claim 19, wherein the balun structure includes one or more shaped openings patterned on the top surface of the package, wherein the balun structure includes at least one of a dumbbell-shaped structure or a double-lobed structure, and wherein the one or more shaped openings include at least one of a circular opening, a rectangular opening, a wedge-shaped opening, a hexagonal opening, a semi-circular opening, a semi-rectangular opening, a semi-polygonal opening, or a semi-hexagonal opening.

23. The waveguide launcher and connector of claim 19, wherein the enclosure compartment of the waveguide connector has one or more inner walls, wherein the one or more inner walls include the terminal end and a top surface, and wherein the slot-line signal converter of the top surface of the package is a bottom surface of the enclosure compartment of the waveguide connector.

24. The waveguide launcher and connector of claim 19, wherein the taper includes at least one of a straight line taper, a stepped taper, a double fin taper, an exponential taper, a quadratic taper, or an elliptical taper, wherein the waveguide connector further includes a plurality of enclosure compartments, and wherein the plurality of enclosure compartments includes a plurality of waveguide launchers and a plurality of tapers.

25. The waveguide launcher and connector of claim 20, wherein the balun structure receives a signal from the microstrip feedline of the package and converts the signal to a slot-line signal, wherein the waveguide launcher converts the slot-line signal to a closed waveguide mode signal with the taper, and wherein the waveguide launcher emits the closed waveguide mode signal along the channel, and wherein the waveguide launcher propagates the closed waveguide mode signal along the taper slot of the waveguide launcher towards the opening of the enclosure compartment of the waveguide connector and to the waveguide.

* * * * *